US005826880A

United States Patent [19]

Cooper

[11] Patent Number: 5,826,880

[45] Date of Patent: Oct. 27, 1998

[54] MULTI-LEVEL CHESS GAME WITH ADDITIONAL CHESS PIECES

[76] Inventor: Stephen R. Cooper, P.O. Box 476, Riverside, Conn. 06878-0476

[21] Appl. No.: 685,193

[22] Filed: Jul. 18, 1996

[51] Int. Cl.[6] ..... A63F 3/02

[52] U.S. Cl. ..... 273/261; 463/14

[58] Field of Search ..... 273/260, 261, 273/241; 463/14

[56] References Cited

U.S. PATENT DOCUMENTS

| | | | |
|---|---|---|---|
| 1,877,154 | 5/1932 | Weaver . | |
| 3,399,895 | 9/1968 | Beach | 273/131 |
| 3,656,756 | 4/1972 | Gribbon, Jr. | 273/131 B |
| 3,684,285 | 8/1972 | Kane | 273/131 AC |
| 3,767,201 | 10/1973 | Harper et al. | 273/131 AC |
| 3,937,471 | 2/1976 | Brennan | 273/131 AC |
| 4,348,027 | 9/1982 | Escamilla-Kelly | 273/241 |
| 5,031,917 | 7/1991 | Greene | 273/241 |
| 5,328,187 | 7/1994 | De Marchi | 273/237 |
| 5,511,793 | 4/1996 | Watt | 273/260 |

FOREIGN PATENT DOCUMENTS

| | | | |
|---|---|---|---|
| 1734806 | 5/1992 | U.S.S.R. | A63F 3/02 |
| 2199506 | 7/1988 | United Kingdom | A63F 3/02 |

OTHER PUBLICATIONS

"Space Chess" Sears advertisement, dated prior to Jan. 1976.

"Star Trek Tridimensional Chess Set" Franklin Mint advertisement, insert from Mar. 9–15, 1996 issue of TV Guide.

*The Oxford Companion to Chess* by D. Hooper and K. Whyld, published 1992, pp. 131, 144. 291–292 and 419.

*Primary Examiner*—Jessica Harrison
*Assistant Examiner*—Michael O'Neill
*Attorney, Agent, or Firm*—Gottlieb, Rackman & Reisman

[57] ABSTRACT

A multi-level chess game for three-dimensional play comprises an odd-numbered plurality of chessboards, means for arranging the chessboards in vertical spaced relation to one another, a pair of conventional sets of standard chess pieces, and at least one pair of supplemental sets of additional chess pieces. The most preferred embodiment of the invention includes only three chessboards and only one pair of supplemental sets of additional chess pieces, with the latter initially positioned on the uppermost chessboard, with the conventional sets of standard chess pieces initially positioned on the lowermost chessboard, and with the intermediate chessboard initially vacant. Rules for play of the game are also disclosed, including rules for movement of the chess pieces from one chessboard to another.

74 Claims, 8 Drawing Sheets

MULTI-LEVEL CHESS GAME WITH ADDITIONAL CHESS PIECES

FIELD OF INVENTION

This invention relates generally to games, and more particularly to a new chess game. Specifically, this invention relates to an expanded chess game that is played in three dimensions on a plurality of chessboards and with additional sets of chess pieces.

BACKGROUND OF THE INVENTION

As is well known, the popular game of chess is of ancient origin, simulating a battle between the forces of two kingdoms. Conventionally, the game is played by two players on a usually square-shaped, flat (i.e., two-dimensional) checkered game board, divided into sixty-four squares of alternating, contrasting (e.g., dark and light) color that are arranged in an eight-by-eight array. In the traditional game of chess, each player is provided with a conventional set of standard chess pieces, each set having the same number and types of playing pieces, with the pieces of each set having visual indicia for differentiation from the pieces of the other set, such indicia typically taking the form of a strong light coloration (e.g., white) applied identically to each of the pieces of one set, and a strong dark or otherwise contrasting coloration (e.g., black) applied identically to each of the pieces of the other set.

A conventional set of standard chess pieces traditionally includes two different classes of playing pieces, i.e., protective pieces and royalty pieces, and each set conventionally includes eight protective pieces, usually consisting of eight identical pawns, and eight royalty pieces of five different types, usually consisting of two identical knights, two identical bishops, two identical rooks, a queen and a king. The manner in which each of these classes and types of playing pieces may be moved on the game board or chessboard is defined by the standard rules of the game, which are set forth at length in United States Chess Federation (1993) The U.S. Chess Federation's Official Rules of Chess, 4th edition, New York: David McKay Chess Library/Random House, Inc., and also in many popular works such as Reinfeld, Fred (1958) Chess in a Nutshell, New York: Pocket Books div. of Simon & Shuster Inc. The relevant portions of both of these works are incorporated by reference herein.

The standard rules of chess define the permitted movements of the protective pieces and of each of the different types of royalty pieces, including the movements by which any of these playing pieces of one player may be moved to a square that is occupied by one of the playing pieces of the opposing player, forcing the latter to be removed permanently from the chessboard for the remainder of the game (such movements will hereinafter be referred to as "capturing moves"). It is generally believed that it is the differences between the movements and capturing moves of the various chess pieces which lends a certain amount of complexity to the game, making the playing of the game a stimulating mental exercise and consequently enhancing its popularity.

In order to make the game even more enjoyable, however, and to challenge the minds of the players still further, games similar to chess have heretofore been devised which are played in three dimensions. U.S. Pat. Nos. 3,767,201, 3,937,471, and 5,031,917 describe such games and are representative of this prior art, as are several such games that have been described only in the literature. Typically these prior art three-dimensional games have deviated from the traditional game of chess, either by adding more classes of pieces, or by adding more squares to the playing area, or even by adding more players. Nevertheless, none of these prior art games has achieved widespread acceptance, probably because they all lacked a sufficient degree of parsimony or economy, which is a term intended herein to quantify in a non-rigorous sense the number of options available to a player for any given move.

The present invention is directed toward a chess game which accommodates the conventional two players, but which is played on multiple levels, i.e., in three dimensions, among a plurality of conventional chessboards, and which includes supplemental sets of additional chess pieces, thereby providing a new chess game of increased complexity.

Accordingly, it is the principal object of the present invention to provide a novel chess game, including an apparatus therefor, which is three-dimensional and which is played in a manner closely paralleling the traditional game of chess.

Another object of the present invention is to provide a novel three-dimensional chess game which permits introduction of variations to the conventional game of chess as a natural extension of the game.

It is a further object of the present invention to provide such a chess game which includes a conventional chessboard and a pair of conventional sets of standard chess pieces.

Yet a further object of the present invention is to provide such a chess game which includes at least two additional chessboards and at least one supplemental set of additional chess pieces for each player, and which permits both the standard chess pieces and the additional chess pieces to be moved not only on each of the chessboards, but also from one chessboard to another.

It is still an additional object of the present invention to provide such a chess game which may be mastered quickly and easily by one who knows the basic rules of conventional chess.

SUMMARY OF THE INVENTION

In accordance with the invention, a multi-level chess game is provided which includes an odd-numbered plurality of conventional chessboards, each having sixty-four squares of alternating, contrasting colors, arranged in standard fashion in an eight-by-eight array. The chessboards are stacked vertically and are spaced apart from one another, with sufficient space between them to accommodate chess pieces of standard size and to permit the physical movement thereof. Preferably, all of the chessboards are substantially identical to one another, and are oriented congruently.

The game also includes two visually distinguishable, conventional sets of standard chess pieces, with each conventional set including eight conventional protective pieces, i.e., eight pawns, and eight conventional royalty pieces, i.e., two knights, two bishops, two rooks, a queen and a king, the two conventional sets of standard chess pieces furthermore being initially positioned opposite one another in standard fashion on one of the chessboards, preferably the lowermost chessboard. At least one pair of supplemental sets of additional chess pieces is also provided, with one member of each pair being visually distinguishable from the other member of that pair, and with each of the supplemental sets including eight additional protective pieces and eight additional royalty pieces. Each pair of supplemental sets of additional chess pieces is initially positioned in standard fashion such that one member of each pair is positioned opposite the other member of that pair, on an odd-numbered chessboard other than the first chessboard. The number of supplemental sets of additional chess pieces is an even number that is one integer less than the odd-numbered plurality of chessboards.

More specifically, and in the preferred embodiments of the invention, the chess pieces in one member of each pair of sets of chess pieces are distinguished by contrasting coloration from the chess pieces in the other member of that pair. In addition, in each of the supplemental sets of additional chess pieces the movements and capturing moves of each of the eight additional protective pieces, on each of the chessboards and between or among the various chessboards, are governed by the same rules as govern the movements and capturing moves of a pawn of the same color on each of the chessboards and between or among the various chessboards. Similarly, in each of the supplemental sets of additional chess pieces, the movements and capturing moves of two of the eight additional royalty pieces are governed by the same rules as govern the movements and capturing moves of a bishop, while the movements and capturing moves of two other additional royalty pieces correspond to those of a knight and the movements and capturing moves of still two other additional royalty pieces corresponds to those of a rook.

Of the remaining two additional royalty pieces in each supplemental set of additional chess pieces, the movements and capturing moves of one such additional royalty piece correspond to those of a queen, and the movements and capturing moves of the other additional royalty piece corresponds to those of a king, except that the latter may not experience castling. It is also preferred that in each of the supplemental sets of additional chess pieces, each of the eight additional protective pieces initially occupies a position corresponding to the conventional initial position of a pawn, and each of the eight additional royalty pieces initially occupies a position corresponding to the conventional initial position of the conventional royalty piece whose movements and capturing moves are governed by the same rules.

Still more preferably, in each of the supplemental sets of additional chess pieces each of the eight additional protective pieces is a pawn, and the eight additional royalty pieces include two bishops, two knights, two rooks, a first additional royalty piece, the movements and capturing moves of which are governed by the same rules as govern those of a queen, and a second additional royalty piece, the movements and capturing moves of which are governed by the same rules as govern those of a king, except that the second additional royalty piece may not experience castling. Furthermore, in each supplemental set of additional chess pieces, each of the additional chess pieces initially occupies a position corresponding to the conventional initial position of its counterpart in a conventional set of standard chessmen, with the first additional royalty piece initially occupying a position corresponding to the conventional initial position of a queen, and the second additional royalty piece initially occupying a position corresponding to the conventional initial position of a king.

In the most preferred embodiment of the invention, three vertically-aligned chessboards are provided. A pair of conventional sets of standard chess pieces (one conventional set of each color, e.g., one black and the other white) are initially positioned opposite one another in standard fashion, in their conventional positions, on the lowermost chessboard. A pair of supplemental sets of additional chess pieces (one supplemental set of each color, e.g., one also black and the other also white) are initially positioned opposite one another in standard fashion on the uppermost chessboard. Each of the supplemental sets of additional chess pieces includes eight identical pawns, two identical bishops, two identical knights, two identical rooks and two additional royalty pieces having, with certain exceptions, most of the characteristics of a queen and a king, respectively.

It is therefore a feature of the most preferred embodiment of this invention that the field of play consists of three chessboards, two of which are initially occupied, and one of which is initially empty but is available for subsequent play.

Another feature of this invention is that each of the two players is initially provided with a conventional set of standard chess pieces of a particular color, as well as at least one supplemental set of additional chess pieces (preferably of a color that matches the color of that player's standard chess pieces), and that any of the chess pieces in either set may be moved both horizontally on any one of the chessboards as well as vertically from one chessboard to another.

Yet another feature of this invention is that the additional chessboards and the potential for vertical attacks provide an increased offensive capability for each player which is partially offset by the stronger defensive capability for each player that is introduced by the additional chess pieces, thereby resulting typically in longer, more complex and more unpredictable chess games.

These and other objects, features and advantages of the present invention will become more apparent from the detailed description of the most preferred embodiments thereof, when read in conjunction with the accompanying drawings, wherein:

FIG. 1 is a perspective view, partially broken away, of a multi-level chess game, and an apparatus therefor, in accordance with a most preferred embodiment of the present invention, in which all of the chess pieces are depicted as labeled tokens, and showing the initial positions of the conventional sets of standard chess pieces thereon, and the initial positions of the single pair of supplemental sets of additional chess pieces thereon, at the commencement of a game;

Figure 8B:
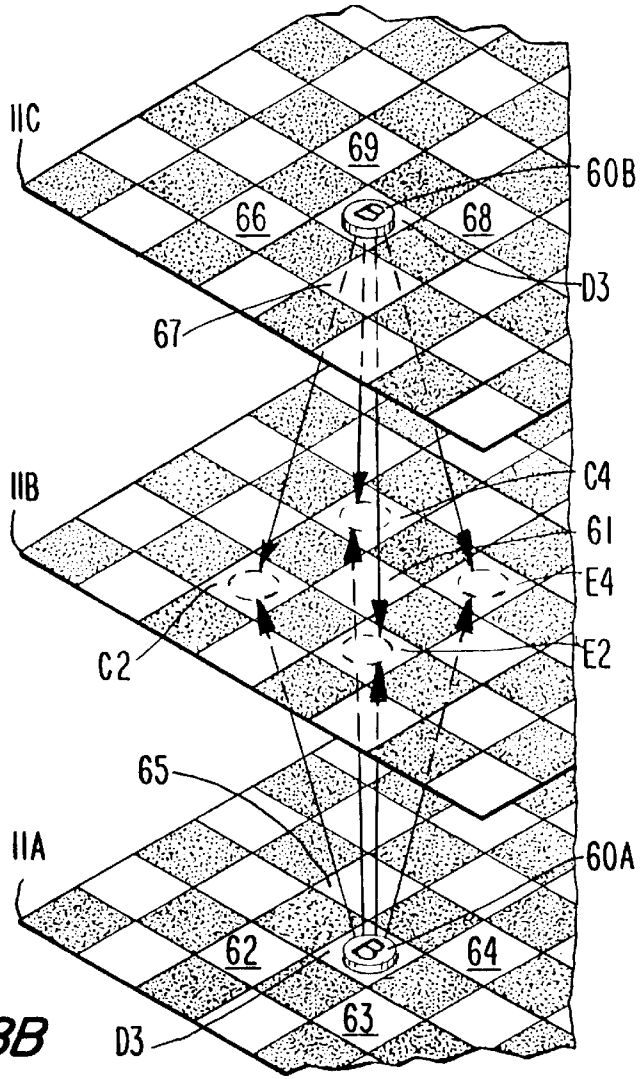
FIGS. 8 through 8C are enlarged perspective views of the chessboards of the embodiment of the apparatus shown in FIG. 1, illustrating the possible vertical moves of a bishop from one chessboard to another.
Figure 8A:
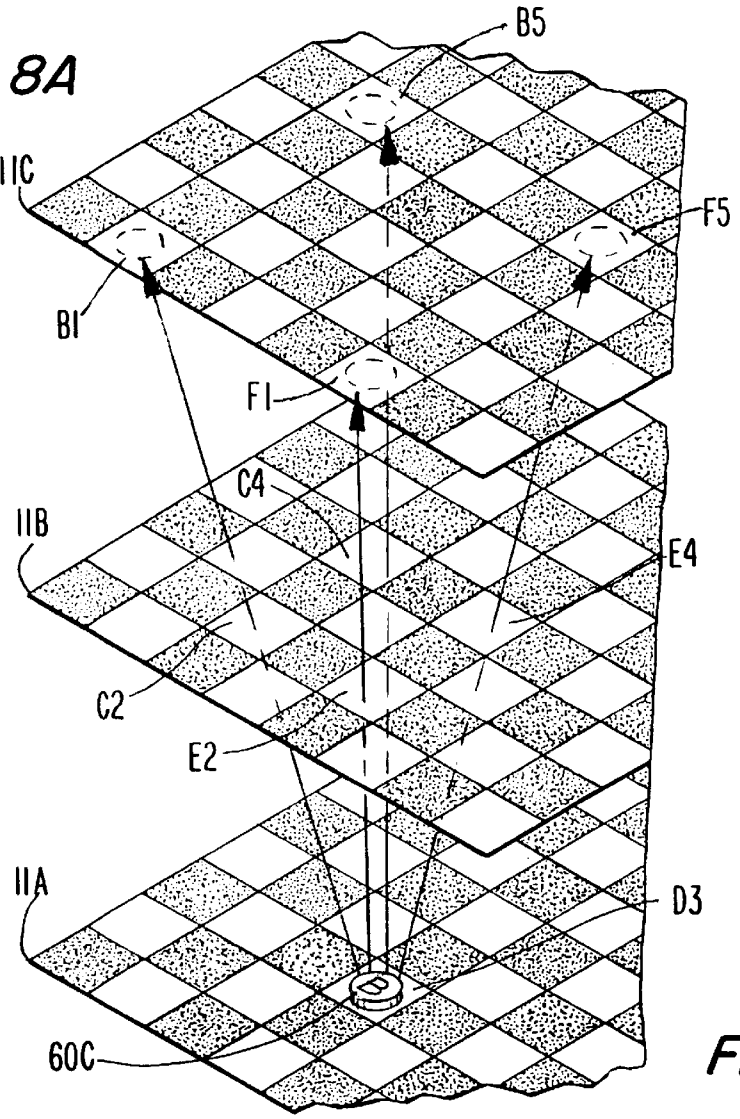
Figure 9:
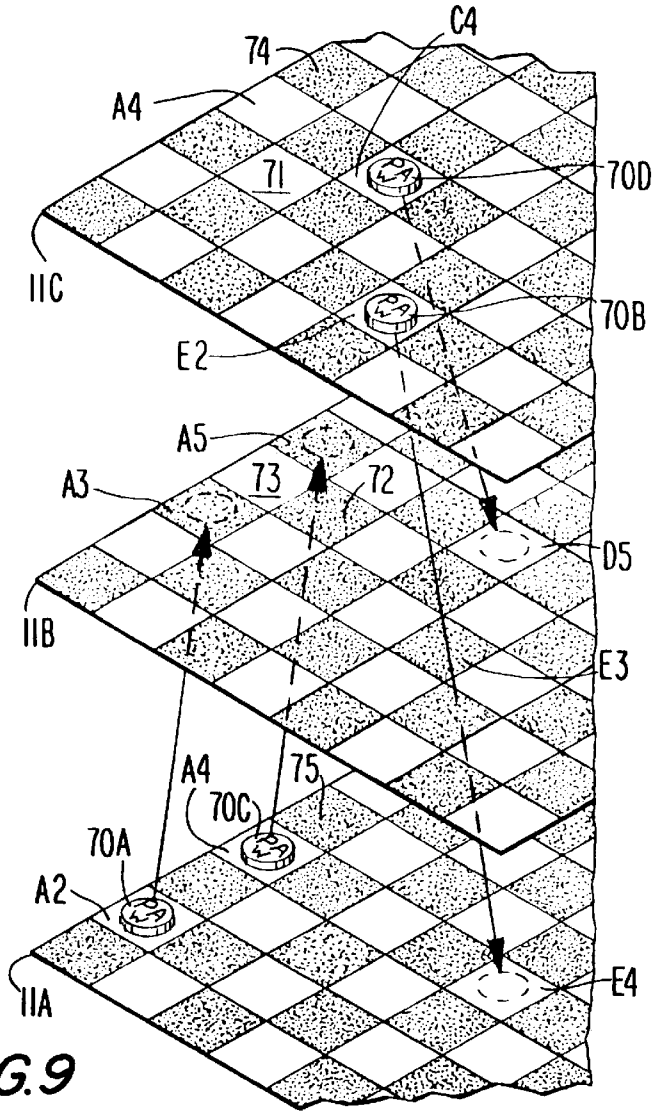
Figure 8C:
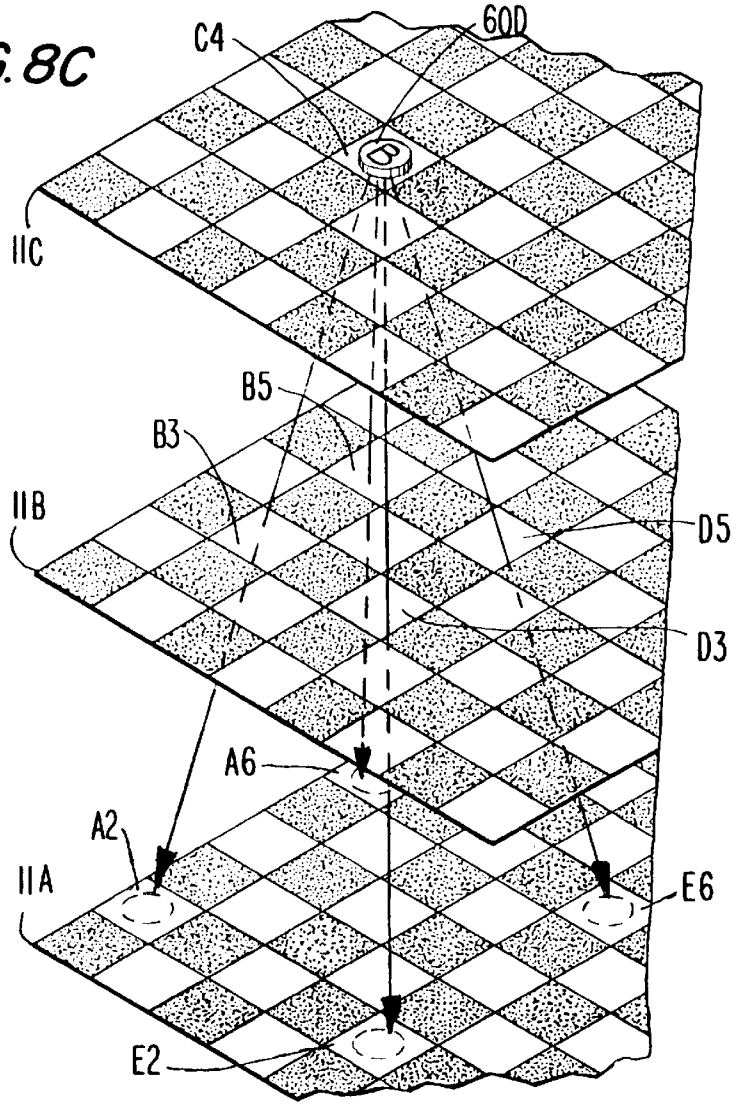
Figure 11:
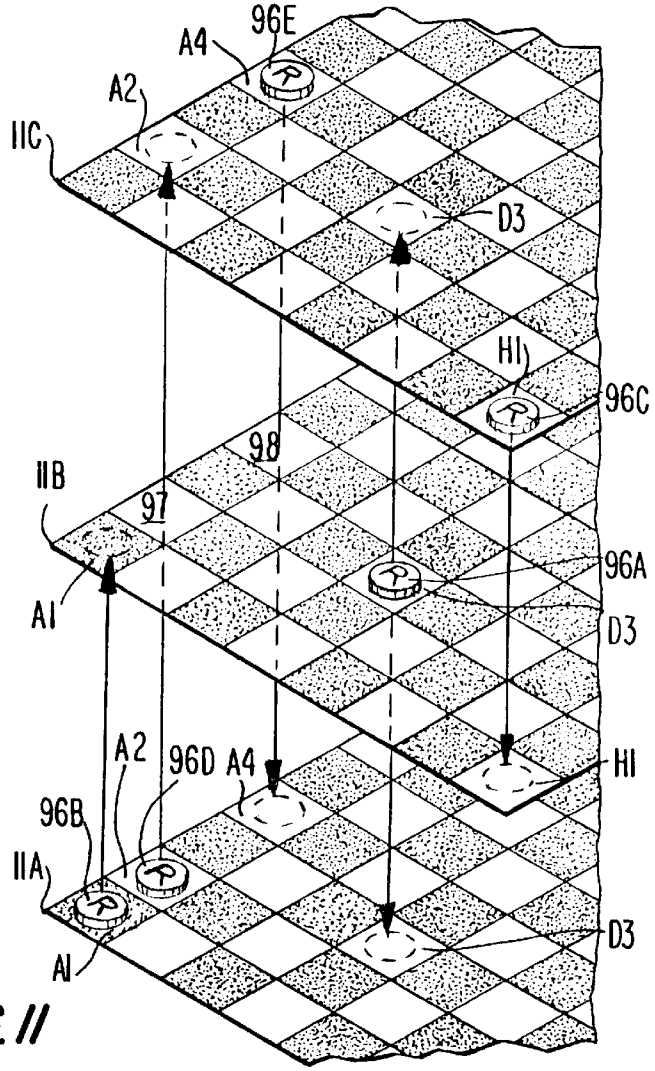
Figure 10:
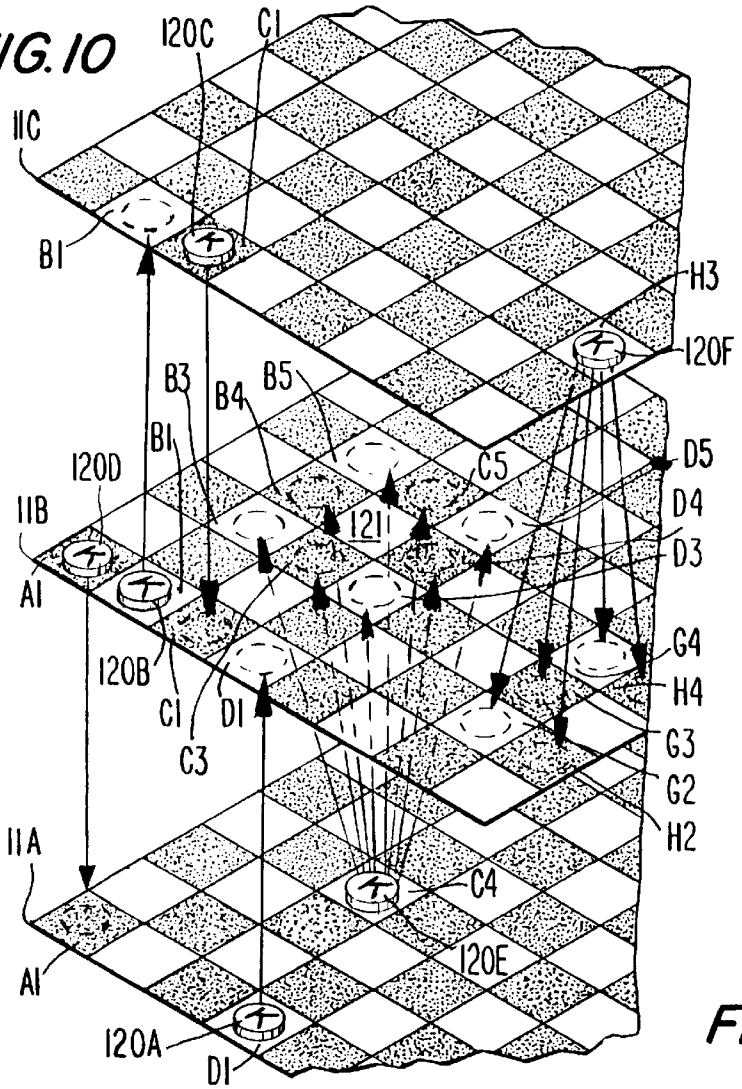
Figure 12B:
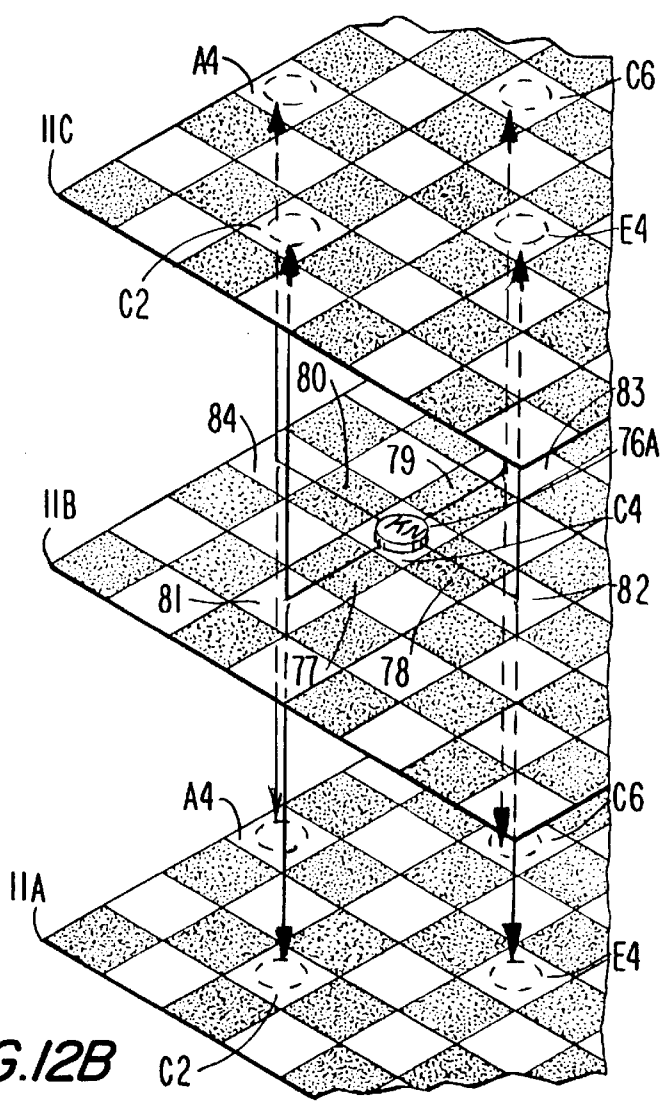
Figure 12A:
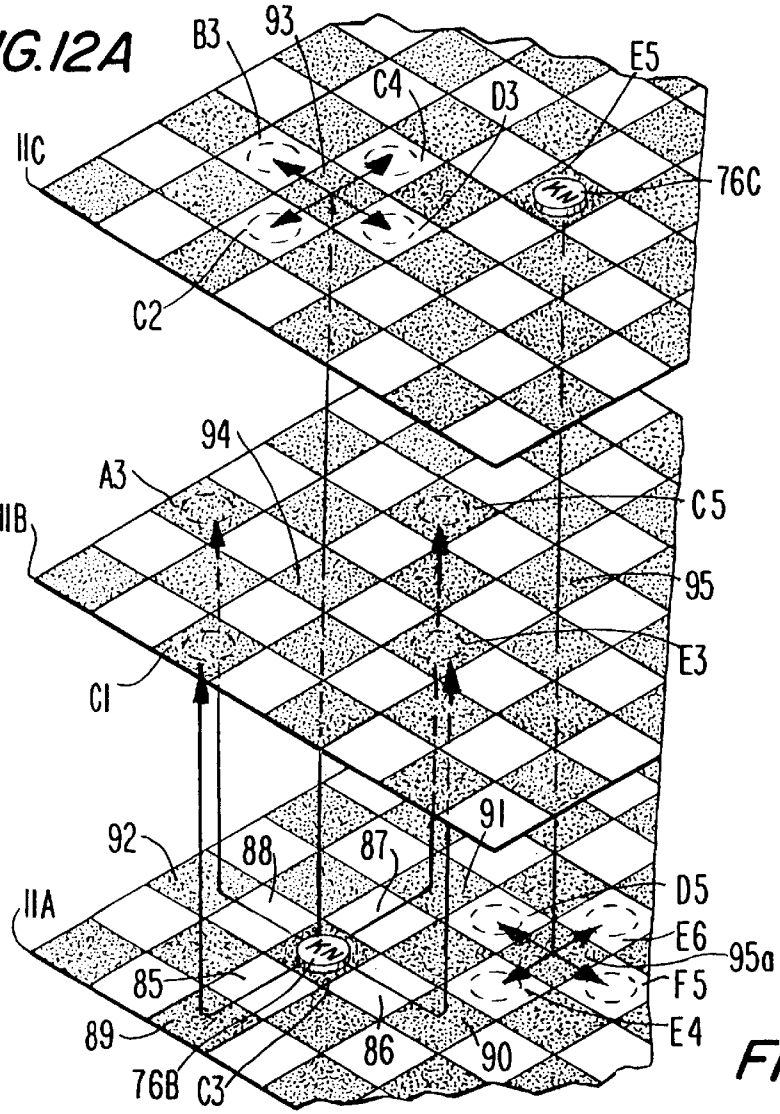
Figure 13B:
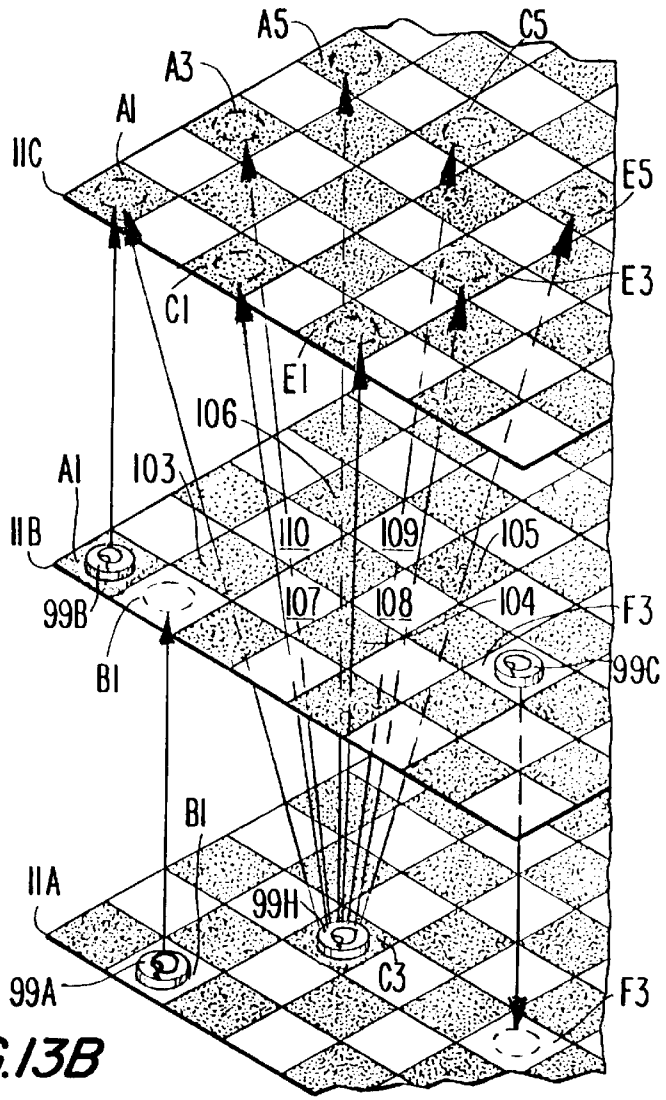
Figure 13A:
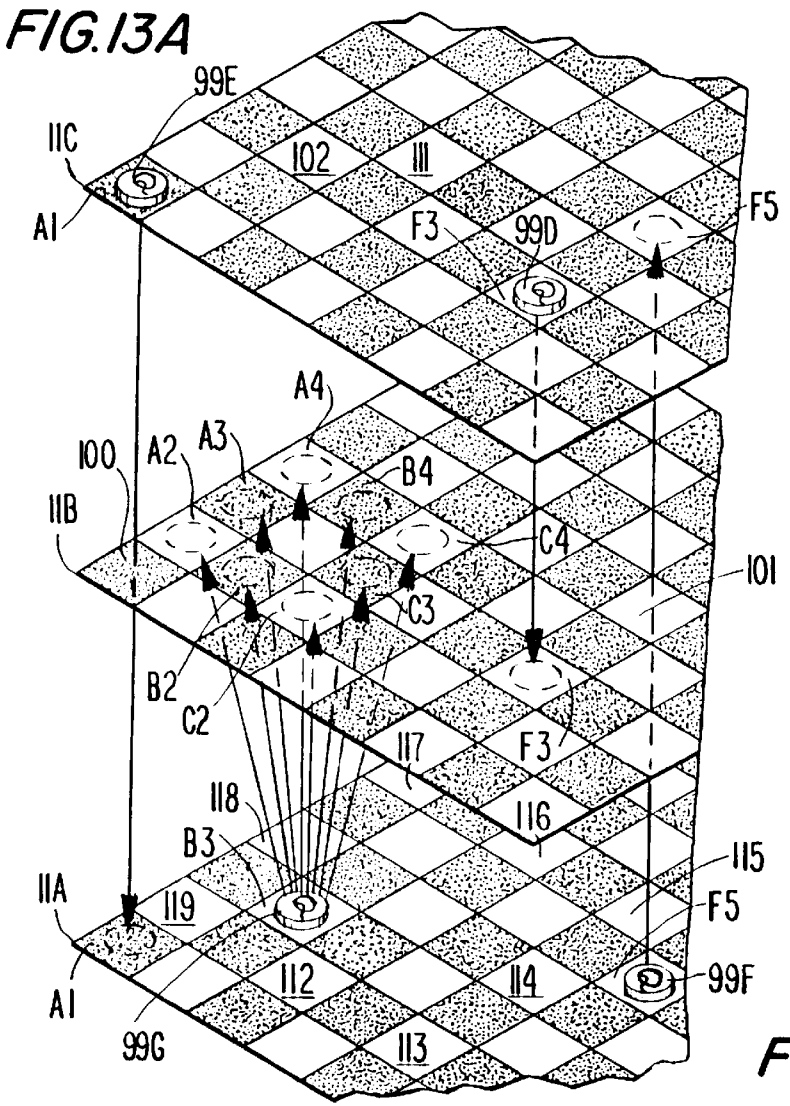

FIGS. 9, 10 and 11 are views similar to that of FIGS. 8A through 8C, but illustrating respectively the possible vertical moves, from one chessboard to another, of a pawn, a king and a rook; and FIGS. 12A through 12B, and FIGS. 13A thorough 13B, are views similar to that of FIGS. 8A through 8C, but illustrating respectively the possible vertical moves, from one chessboard to another, of a knight and a queen.

DETAILED DESCRIPTION OF THE PREFERRED EMBODIMENTS

Figure 1:
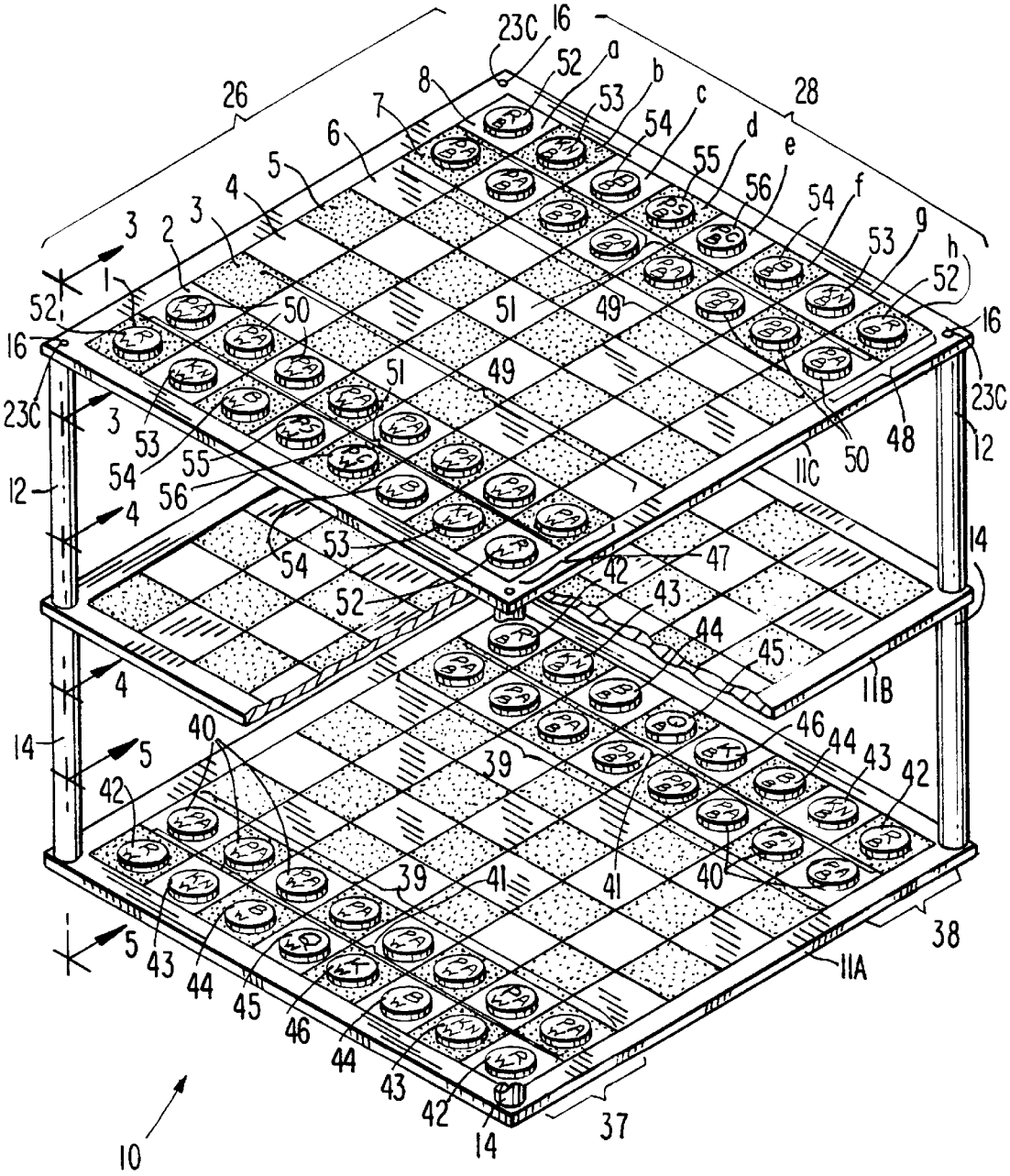

With reference now in more detail to the drawings, and in particular to FIG. 1 thereof, an apparatus for playing the expanded multi-level chess game of the present invention, embodying the principles and concepts thereof and illustrating the most preferred embodiment thereof, is generally designated by the reference numeral 10.

Apparatus 10 includes three identical, planar, substantially square chessboards 11A, 11B and 11C, each of which has playing squares that alternate in contrasting colors in the usual way or are otherwise visually distinguishable. When in use, the chessboards are oriented horizontally, i.e., parallel to a table top (not shown) or to the ground (also not shown). Apparatus 10 therefore also includes means for arranging chessboards 11A, 11B and 11C in vertical spaced relation at a predetermined distance from one another.

Referring now to FIGS. 2–6 in addition to the aforementioned FIG. 1, the arranging means illustratively includes a plurality of spacer posts, each having at least one projecting end portion, and the arranging means also includes at least one opening in each of the chessboards, adapted to receive the projecting end portions of the spacer posts, which are secured therein, for example, with a friction fit. As shown best and in detail in FIGS. 2–5, the illustrative and preferred embodiment of the arranging means includes two different types of spacer posts 12, 14 (preferably four of each). The two different types of spacer posts 12, 14 that are shown in the drawings are sufficient when they are used in conjunction with the embodiments of the invention having only three chessboards. However, a third type of spacer post (not shown), which will be described hereinbelow, will likely be utilized in conjunction with other embodiments of the invention having more than three chessboards.

Figure 2:
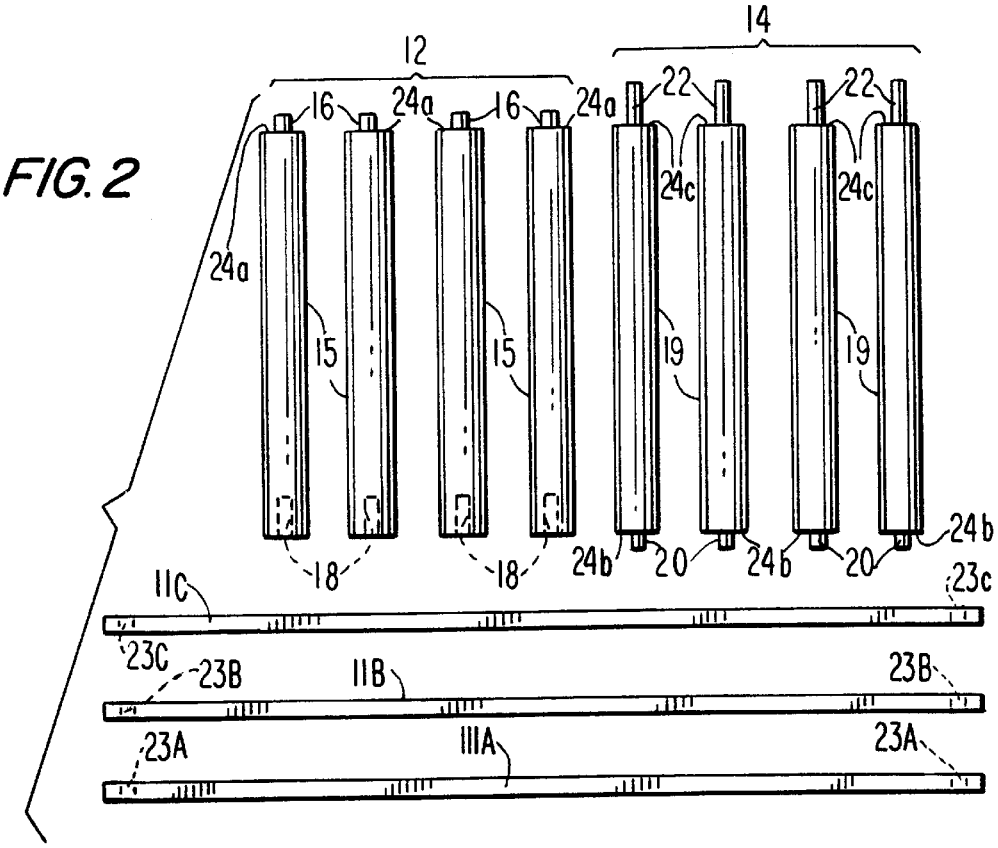
FIG. 2 is a composite view of the structural parts of the illustrative chess game apparatus shown in FIG. 1.

As shown in FIG. 2, upper spacer posts 12 and lower spacer posts 14 are of predetermined, substantially equal length, with upper spacer posts 12 each having an illustratively cylindrical body portion 15, a short coaxial illustratively cylindrical projecting end portion 16 at one end thereof and a longer coaxial illustratively cylindrical inwardly-extending opening 18 at the opposite end thereof, and with lower spacer posts 14 each having an illustratively cylindrical body portion 19, a short coaxial illustratively cylindrical projecting end portion 20 at one end thereof and a longer coaxial illustratively cylindrical projecting end portion 22 at the opposite end thereof.

Preferably, the body portions 15 of upper spacer posts 12 and the body portions 19 of lower spacer posts 14 are of substantially equal diameter, while projecting end portions 16, 20 and 22 as well as inwardly-extending openings 18 are of reduced diameter as compared with respective body portions 15 and 19, with the diameter of inwardly-extending opening 18 of each upper spacer post 12 being slightly larger than the diameter of projecting end portion 22 of each lower spacer post 14, and with the length of end portions 22 being slightly shorter than the length of interior openings 18, the diameters and lengths of these elements being thus chosen in order to accommodate engagement therebetween in a friction fit.

The illustrative and preferred embodiment of the arranging means also includes, in each of chessboards 11A, 11B and 11C, four identical, illustratively cylindrical openings 23A, 23B and 23C, preferably positioned at the four corners of the chessboards, each of the cylindrical openings 23A, 23B and 23C being of sufficient diameter and length to accommodate and to engage (also in a friction fit) the projecting end portions 16, 20 and 22 of the spacer posts 12, 14. Each of spacer posts 12 also includes a shoulder portion 24*a* where end portion 16 meets body portion 15, and each of spacer posts 14 also includes shoulder portions 24*b*, 24*c* where respective end portions 20 and 22 meet body portion 19, thereby allowing the portions of chessboards 11A, 11B and 11C that are adjacent to openings 23A, 23B and 23C to rest securely against the ends of the respective spacer posts.

Figure 3:
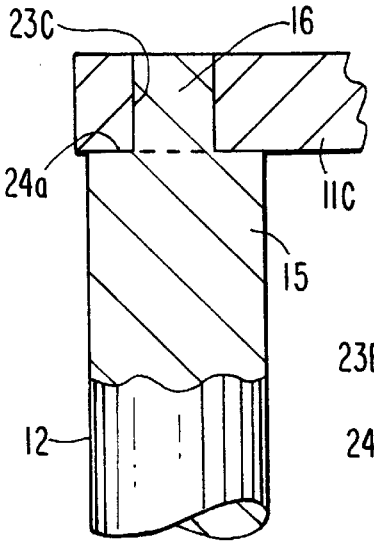
FIG. 3 is a cross-sectional view taken substantially along the lines 3—3 of FIG. 1.
Figure 4:
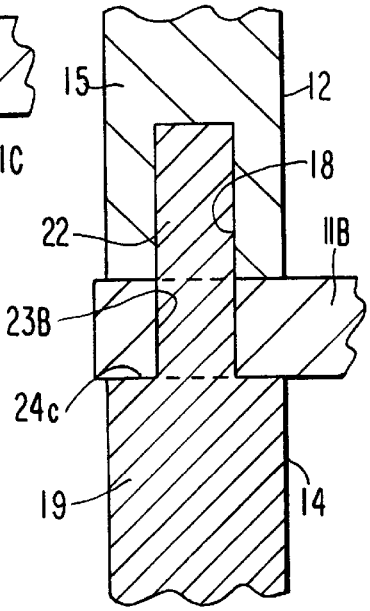
FIG. 4 is a cross-sectional view taken substantially along the lines 4—4 of FIG. 1.
Figure 5:
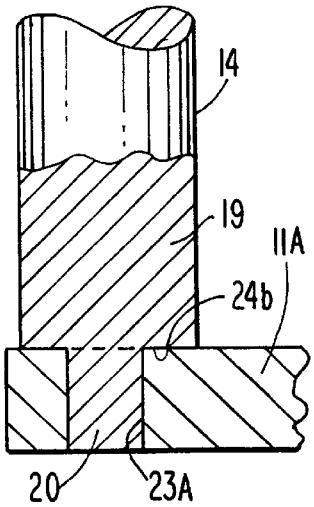
FIG. 5 is a cross-sectional view taken substantially along the lines 5—5 of FIG. 1.

FIGS. 3, 4 and 5 illustrate in detail how the spacer posts 12, 14 and chessboards 11A, 11B and 11C may be cooperatively interconnected utilizing openings 23A, 23B and 23C, so as to form the arranging means for the game apparatus 10. Preferably, the arranging means is adapted to allow the chessboards to be removably secured to the spacer posts, allowing assembly of the game apparatus prior to play, and disassembly thereof thereafter for storage; however, it is to be understood that the alternative option, wherein the apparatus is permanently assembled (and cannot thereafter be disassembled without also destroying the apparatus), is also within the scope of the invention.

As mentioned hereinabove, and as will be evident to those of ordinary skill in the mechanical arts, at least one third type of spacer post (not shown) must be included in the arranging means for use with embodiments of the invention in which there are more than three chessboards. Preferably, there will be four such intermediate spacer posts, and each intermediate spacer post will be substantially identical to spacer posts 12, 14, except that at one end thereof it will have longer coaxial illustratively cylindrical projecting end portions (similar to the end portions 22 of lower spacer posts 14) and at the opposite end thereof it will have coaxial illustratively cylindrical inwardly-extending openings (similar to the openings 18 in upper spacer posts 12). Thus, the intermediate spacer posts will be adapted at one end to engage with an upper spacer post 12 (or with another intermediate spacer post) and to interconnect with a chessboard that is interposed therebetween, all in a friction fit, and will be adapted to engage at the other end with a lower spacer post 14 (or with another intermediate spacer post), and to interconnect with another chessboard that is interposed therebetween, also in a friction fit.

Since the upper and lower spacer posts 12, 14 (and the intermediate spacer posts as well) are preferably substantially equal to one another in length, the chessboards, when arranged securely therewith, will be spaced apart a predetermined distance from one another, and will be oriented in parallel planes. Moreover, although not strictly required, it is preferred that chessboards 11A, 11B and 11C be arranged congruently, so that the respective playing squares of alternating dark and light color of the playing surface of lowermost chessboard 11A are aligned vertically with the counterpart playing squares on the surfaces of intermediate chessboard 11B and uppermost chessboard 11C. Thus, in the most preferred embodiment the chessboards are identically oriented, such that the pattern of squares on the playing surfaces of chessboards 11A, 11B and 11C are aligned if viewed from directly above uppermost chessboard 11C, as shown best in FIG. 1.

Figure 6:
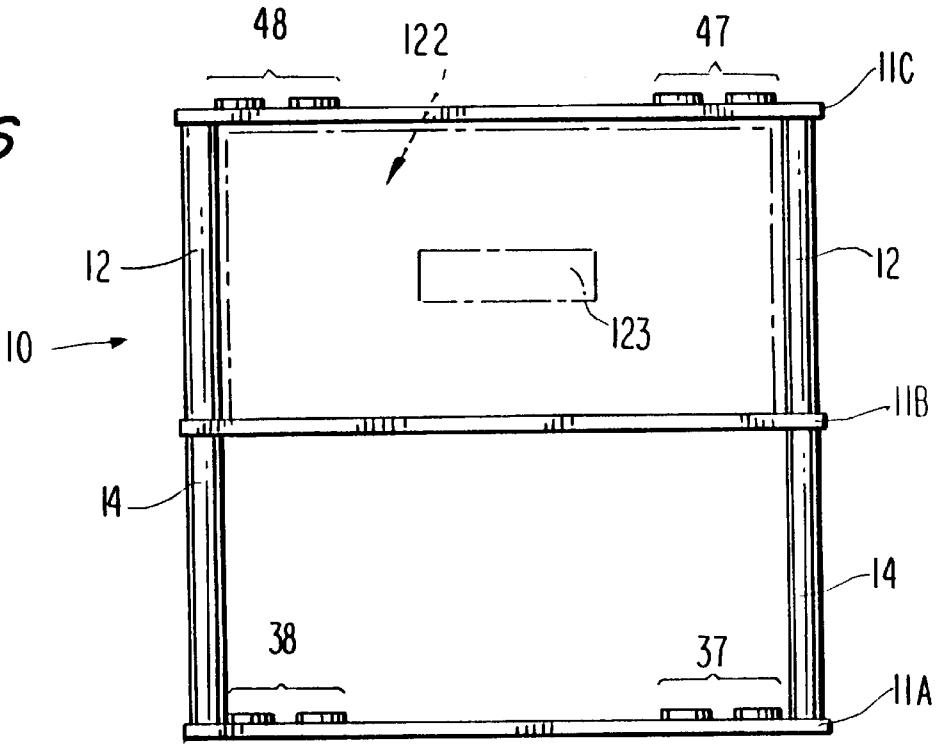
FIG. 6 is a side elevational view of the embodiment of the apparatus shown in FIG. 1.

As will be evident, the game apparatus 10, with the illustrative arranging means depicted in FIGS. 1–6, is preferably positioned for play of the game such that when lowermost chessboard 11A is placed (as shown in FIG. 6) on a flat surface such as a table top (not shown), all of the chessboards, i.e., the chessboards 11A, 11B and 11C, and especially the playing surfaces thereof, are oriented substantially horizontally. Optionally, the uppermost chessboard 11C and the intermediate chessboard 11B are partially (and preferably substantially) transparent, not only to facilitate viewing (and envisioning the potential moves of) the chess pieces that are present on intermediate chessboard 11B and lowermost chessboard 11A during the progress of the game, but also to facilitate the actual playing of the game, i.e., the actual movement of the chess pieces on each of the chessboards and from one chessboard to another.

An optional enhancement for the above-described embodiment of the arranging means (in which the chessboards are stacked one above the other) is the provision of mechanical means for each player to grasp and transport chess pieces from one chessboard to another, or even from one square to another square on one of the chessboards other than the uppermost chessboard. Illustratively, such mechanical grasping means would preferably take the form of a pair of conventional tongs. The use of such grasping means would facilitate the play of the game by permitting the game apparatus to be designed in a more compact fashion, i.e., it would enable the spacer posts to be made shorter, thereby enabling the chessboards to be spaced more closely together.

Although a preferred structure for the arranging means is described hereinabove and is shown in the drawings, it is to be understood that that structure is illustrative only, and that many other structures for the arranging means are possible which will still allow the chessboards to be orientated in a stacked fashion. For example, the spacer posts themselves, and/or the projecting end portions thereof and/or the inwardly-extending openings therein, need not be cylindrical in shape, i.e., their cross-sections need not necessarily be circular, so long as their shapes, and the shapes of the openings in the chessboards that receive those end portions, are of matching cross-section so as to facilitate a friction fit between them. Also, instead of spacer posts and openings in the chessboards, the arranging means may include one or more cross members/beams that are either removably or permanently affixed, either vertically or diagonally (e.g., in an X, Z, or >–<design), to the outer edges of each of the chessboards. The cross members/beams need not necessarily be attached to the chessboards at their corners; alternatively, the points of attachment may be indented somewhat from the corners, or they may even be positioned at or near the mid-point of an outer edge of each chessboard.

As another alternative, the arranging means may include a free-standing column to which chessboards may be rigidly attached in stacked fashion, either removably or permanently, and either directly to, or by means of struts or branches projecting from, the column. In a variation of this embodiment, each chessboard would be moveable, e.g., each chessboard would be individually affixed to the column by means of a hinge. This would enable the players to swing each chessboard away from the column independently, allowing easy access to each of the lowermost and intermediate chessboards without the use of grasping means such as tongs.

In addition to the foregoing, other structures for the arranging means are possible which would allow the chessboards to be oriented in a non-stacked fashion. For example, the chessboards could be attached to a freestanding column (as above), but arranged as though they were steps on a spiral staircase. Thus, each chessboard could be removably or permanently affixed, preferably at an identical corner, either to the column itself or to branches linked to the column. The chessboards could be attached either with no overlap among them, i.e., with each chessboard attached to the column at a 90-degree angle of rotation around the column as compared with the chessboard above or below it, or with some overlap, e.g., each chessboard could be attached to the column at a 45-degree angle of rotation around the column as compared with the adjacent chessboard(s).

As another alternative, the chessboards could be arranged as though they were steps in a straight (i.e., non-spiral) staircase, with each chessboard overlapping the one below it slightly (e.g., by a few rows of squares). In this embodiment, the arranging means might include a plurality of right triangular cross members/beams to which the chessboards would be removably or permanently affixed at their edges.

Referring now again to the aforementioned FIG. 1, in addition to the apparatus 10 and its arranging means, the invention further includes a pair of conventional sets of standard chess pieces. One of these two sets is assigned to one player, while the other set is assigned to the opposing player, and in order to differentiate visually the chess pieces of one player from those of the opposing player, preferably the playing pieces in each set are all provided in one matching color, with the coloration of the chess pieces in one of the two sets preferably contrasting with the coloration of the chess pieces in the other of the two sets. Most preferably, for one player the conventional set of standard chess pieces is colored white, while the opposing player's conventional set of standard chess pieces is colored black, as they usually are in a traditional game of chess. Preferably, the alternating contrasting colors of the squares on the playing surfaces of chessboards 11A, 11B and 11C will generally match the contrasting colors of the chess pieces, and most preferably the squares will alternately be colored black and white, as on a traditional chessboard (but subject to the option for substantial transparency as mentioned hereinabove), although other contrasting colors may be used instead.

As indicated in FIG.1, each of chessboards 11A, 11B and 11C is subdivided into sixty-four playing squares, arranged in eight parallel rows or ranks 26, each of which runs across the chessboards from one side to the other (i.e., from each player's left to that player's right, or vice-versa), and eight parallel columns or files 28, each of which runs across the chessboards from one player towards the opposing player, transversely to the ranks. As in a traditional, two-dimensional game of chess, the ranks 26 may be designated (as shown in FIG. 1) with the numerals 1 through 8, traditionally in ascending numerical order from the side of the board where the white chess pieces are initially positioned to the opposite side of the board where the black chess pieces are initially positioned. Similarly, the files 28 are traditionally designated with the lower case letters a through h, in ascending alphabetical order from the left hand side of the board to the right hand side of the board (from the perspective of the player to whom the white chess pieces are assigned). These designations are illustratively shown in FIG. 1, but only for uppermost chessboard 11C. Nevertheless, in designating hereinbelow (and in FIGS. 8A through 13B) some of the individual squares on each of the chessboards, using a unique combination of a number and a letter (corresponding respectively to the rank and the file which intersect at each such square), the capital letters A through H, rather than the lower case letters, are used.

Figure 7:
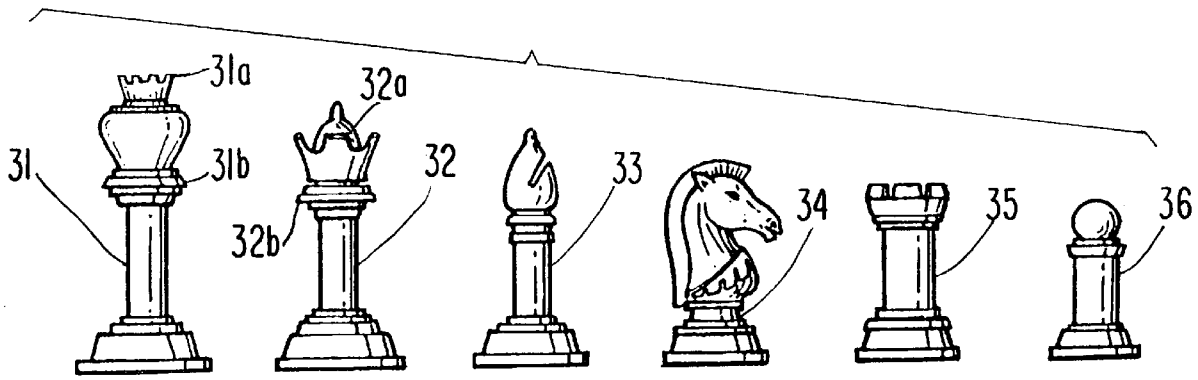
FIG. 7 is a composite elevational view of a plurality of chess pieces for use in playing on the apparatus of FIGS. 1 and 6.

Referring now to FIG. 7 in addition to the aforementioned FIG. 1, the physical playing pieces used to represent the chess pieces in each of the two conventional sets of chess pieces preferably take the traditional forms shown in the drawing, i.e., a king 31, a queen 32, a bishop 33, a knight 34, a rook 35, and a pawn 36, although these standard chess playing pieces may be reduced in size or flattened somewhat to enable the chessboards to be oriented in closer spaced relation than would otherwise be the case, thereby reducing the potential height of the overall physical game apparatus 10. For ease of illustration and for clarity of understanding, however, these standard chess playing pieces are symbolized in the aforementioned FIGS. 1 and 6 (and also in FIGS. 8A through 13B) by round, checker-like "tokens" that are textually labeled (except in FIG. 6), for purposes of identification, with the designations listed in Table I, and with the additional designations "W" or "B" (in FIGS. 1 and 9 only) to indicate that the color of the playing piece is illustratively either white or black, respectively.

TABLE I

| Chess Piece | Designation |
|---|---|
| Kings | K |
| Queens | Q |
| Bishops | B |
| Knights | KN |
| Rooks | R |
| Pawns | PA |

Thus, as shown in FIG. 1, the conventional sets of standard chess pieces 37, 38 are preferably initially positioned on lowermost chessboard 11A. Each of the conventional sets of standard chess pieces 37, 38 includes eight protective pieces 39, comprising eight identical pawns 40, and also includes eight royalty pieces 41, comprising two identical rooks 42, two identical knights 43, two identical bishops 44, a queen 45 and a king 46. The conventional sets of standard chess pieces 37, 38 are initially positioned opposite one another, in standard fashion as shown in FIG. 1, with the eight royalty pieces 41 and the eight protective pieces 39 of the illustratively white set of chess pieces 37 initially occupying their traditional starting squares along the first and second ranks, respectively, of lowermost chessboard 11A, and with the eight protective pieces 39 and the eight royalty pieces 41 of the illustratively black set of chess pieces 38 being arrayed for the commencement of play along the seventh and eighth ranks, respectively, of the same chessboard.

In the most preferred embodiment of the present invention, as illustrated in FIG. 1, a pair of supplemental sets of additional chess pieces 47, 48 is also provided, and is initially positioned on uppermost chessboard 11C. Each of the supplemental sets of additional chess pieces includes eight additional protective pieces 49, preferably eight identical pawns 50, and eight additional royalty pieces 51, preferably two identical rooks 52, two identical knights 53, two identical bishops 54, and two other additional royalty pieces 55, 56, which are referred to hereinbelow as a prince 56 and a princess 55, although any other pair of preferably traditional names (e.g., duke and duchess, count and countess, etc.) may be used instead without departing from the spirit and scope of the invention. For clarity and ease of understanding, in FIG. 1 the tokens representing the prince and princess chess pieces are labeled with the designations PC and PS, respectively.

One of the supplemental sets of additional chess pieces is assigned to one player, and the other supplemental set of additional chess pieces is assigned to the opposing player, and in order to differentiate the chess pieces of one player from those of the other player, preferably the playing pieces in each of these two sets are all provided in one matching color, with the color of the chess pieces in one of the two supplemental sets preferably contrasting with the color of the chess pieces in the other of the two supplemental sets. Most preferably, for one player the supplemental set of additional chess pieces is colored white, while the opposing player's supplemental set of additional chess pieces is colored black. Regardless of the specific colors used, however, it is preferred that the coloration of the supplemental set of additional chess pieces 47 match the coloration of the conventional set of standard chess pieces 37, and that the coloration of the supplemental set of additional chess pieces 48 match the coloration of the conventional set of standard chess pieces 38, so that all of the forces of one player may be differentiated easily, in immediate visual fashion, from all of the forces of the opposing player, especially at later stages during the course of play of the game when the forces of both players may be spread out in various positions on any of the chessboards.

Preferably, the physical playing pieces representing the prince 56 and princess 55 in each of the supplemental sets of additional chess pieces 47, 48 will resemble the physical playing pieces representing the king 46 and queen 45, respectively, in the conventional sets of standard chess pieces 37, 38. The traditional physical forms of the playing pieces representing the kings and queens are designated by the numerals 31 and 32, respectively, in FIG. 7, and these same playing pieces may be used to represent princes and princesses, respectively, as well. However, it is also preferable that some sort of means be provided to distinguish the physical playing pieces representing the princes 56 from the physical playing pieces representing the kings 46, and also to distinguish the physical playing pieces representing the princesses 55 from the physical playing pieces representing the queens 45.

This can be accomplished, for example, by adding striping or other additional coloration only to the physical playing pieces representing the black and white kings 46 and the black and white queens 45. Specifically, as indicated in FIG. 7, the crowns 31*a*, 32*a*, or the neck areas 31*b*, 32*b*, of the traditional physical playing pieces 31, 32, respectively, could be provided with a distinguishing color, e.g., gold or silver, to represent the black and white kings 46 and black and white queens 45, while on the physical playing pieces representing the black and white princes 56 and the black and white princesses 55, the crown and/or neck areas would not be colored gold or silver, but would instead bear the same colorations as the remainder of each of the respective physical playing pieces 31, 32, i.e., either black or white.

No such distinguishing coloration or striping is necessary for the remaining playing pieces in each of the supplemental sets of additional chess pieces, since, except for their initial positioning, there is essentially no difference between the bishops, knights, rooks and pawns of the conventional sets of standard chess pieces 37, 38 and the respective bishops, knights, rooks and pawns of the supplemental sets of additional chess pieces 47, 48. Accordingly, in the most preferred embodiment of the invention, each player is provided with a total of thirty two chess pieces, consisting of sixteen pawns, four knights, four bishops, four rooks, a prince, a princess, a queen and a king, all of which are preferably colored identically.

Most preferably, and as shown in FIG. 1, the supplemental sets of additional chess pieces 47, 48 are initially positioned opposite one another in standard fashion on uppermost chessboard 11C, in the positions along the first, second, seventh and eighth ranks of that chessboard that correspond to the positions of the counterpart chess pieces in the conventional sets of standard chess pieces 37, 38 on lowermost chessboard 11A, except that the princes and princesses are initially positioned on uppermost chessboard 11C in the squares that correspond to those initially occupied by the kings and queens, respectively, on lowermost chessboard 11A. Thus, as the game begins, each player has a conventional set of standard chess pieces arranged in the standard manner on lowermost chessboard 11A, and in the most preferred embodiment, each player has a supplemental set of additional chess pieces arranged as shown in FIG. 1 on uppermost chessboard 11C, although the sets of chess pieces on the lowermost and uppermost chessboards could be interchanged if desired, simply by interchanging the initial positions of the prince and princess of one or both players with that of the king and queen, respectively, of the respective player(s). In any event, however, as shown in FIGS. 1 and 6, the intermediate chessboard 11B is initially vacant of chess pieces, at the outset of the game.

Once play of the game begins, preferably the standard rules of chess (as set forth in the above-cited references) are used in playing the multi-level chess game of the present invention, except for the rules for tournament play, which will not apply, and except for the modifications hereinafter described which are necessary in order to adapt the game to three dimensions. Thus, under the preferred rules of the game, the movements and capturing moves of each of the chess pieces with respect to the chessboard on which it is positioned are governed by essentially the same rules as govern the movements of those chess pieces in a traditional, two-dimensional game of chess.

Specifically, and to summarize the standard rules that govern the movements of the traditional chess pieces within the confines of one chessboard, each pawn may be moved one or two open squares from its initial position on its first move of the game, and one open square from its current position on each subsequent move of the game, and may capture only by moving one square diagonally, all subject to the limitation that pawns may only be moved forwards, i.e., towards the opposite side of the chessboard from their initial positions and generally towards the chess pieces of the opposing player; each bishop may be moved any number of open squares along either one of the diagonals passing through the square on which it is currently positioned; each knight may be moved first two squares along either the rank or the file passing through the square on which it is currently positioned, and then one additional square at right angles thereto; each rook may be moved any number of open squares along either the rank or the file passing through the square on which it is currently positioned; each queen may be moved any number of open squares along either the rank or the file or one of the diagonals passing through the square on which it is currently positioned (i.e., each queen may be moved as a rook or as a bishop); and each king may be moved in directions similar to that of a queen, but only one open square at a time from its current position, except that a king may be moved two open squares during the unique, once-per-game (for each player) movement known as castling, in which the king's rook is also moved (from its initial position) to the other side of the king.

In addition to the foregoing, in accordance with the present invention the movements and capturing moves of each prince and of each princess with respect to the chessboard on which it is situated are governed by the same rules as govern the movements and capturing moves of a king and a queen, respectively, as set forth in the previous paragraph, although unlike a king, a prince may not experience castling and, more importantly, if a prince is captured the game would continue since, as in traditional, two-dimensional chess, the object of the game is to "checkmate" the opposing player's king, i.e., to force the opposing player's king into such a position that it cannot avoid capture.

Thus, there is only one king (of each color), and therefore in a strict sense only the kings need be visually distinguishable from the princes. There is no real difference between the queen and the princess of the same color (except for their initial positions at the start of the game); they are equivalent (they are, in fact, two queens), and the game would continue even if both were to be captured. However, a distinction between the queens and the princesses of each color is suggested herein merely because it would be awkward and perhaps confusing, as well as a breach of the protocol associated with the historical analogy between the game of chess and a battle between opposing kingdoms, to call all four pieces "queens," since thereby each king would have more than one official consort.

As shown best in FIG. 1, all thirty two chess pieces of one color begin play on one side of apparatus 10, while all thirty two chess pieces of the contrasting color begin play on the opposite side of apparatus 10. Thus, at the beginning of the game, the illustratively white chess pieces on uppermost chessboard 11C are preferably positioned directly above the corresponding illustratively white chess pieces on lowermost chessboard 11A, and the same is true of the black chess pieces. As in traditional, two-dimensional chess, the chessboards (i.e., the apparatus 10) must be positioned such that each player has a white (or lighter-colored) square at his or her right hand corner on all three chessboards 11A, 11B, 11C, and the white (or lighter-colored) queen and princess must always be positioned initially on a white (or lighter-colored) square, while the black (or darker-colored) queen and princess must always be positioned initially on a black (or darker-colored) square.

Also as in traditional chess, all of the chess pieces except the knights may be moved only along unobstructed lines, i.e., for all of the chess pieces, on each move the destination square must either be unoccupied or be occupied by a chess piece of the opposing player (in the latter case the opposing player's piece can thus be captured, i.e., removed from the field of play), and for all of the chess pieces except the knights, on each move all of the squares between the starting square and the destination square must be unoccupied.

During play of the game of the present invention, any of the chess pieces may be moved to any of the chessboards (subject to the same limitations that are set forth hereinabove regarding movement along unobstructed lines, and in accordance with the rules for movement from one chessboard to another chessboard that are set forth in detail hereinbelow) and, after being moved from one chessboard to a different chessboard, each chess piece may thereafter (on the player's next turn or on a subsequent turn) be moved on the destination chessboard according to the rules of traditional, two-dimensional chess (with the minor exceptions noted hereinbelow), or be moved back to the starting chessboard for that piece or to yet another destination chessboard (in accordance with the rules hereinafter set forth). Thus, at any point during a game, it is possible, for example, for all four of a player's rooks, or both the queen and princess of a player, to be moved to, and thereafter to continue play on, the same chessboard at the same time.

Referring now in particular to FIGS. 8A through 13B of the drawings in addition to the aforementioned FIGS. 1–7, the rules for movement of each of the chess pieces from one chessboard to another chessboard, according to the invention, which augment the standard rules of chess that govern their movement within the confines of one chessboard, will now be described in detail. In FIGS. 8A through 13B, the tokens representing the chess pieces are each shown moving from a starting position (in which the token is depicted in solid lines), in the direction of the arrows, to a destination position on a different chessboard (on which the token is depicted in phantom lines, without any textual labelling).

In the following descriptions, reference will be made to three different types of movements from one chessboard to another: vertical leaps (i.e., straight up or straight down), as well as two different kinds of step-wise vertical moves, referred to hereinafter as full-sided vertical steps and diagonal steps. A full-sided vertical step is defined as the movement of a piece from one chessboard to the chessboard immediately above or below the starting chessboard, in which the destination square shares an edge with the square on the destination chessboard that is directly above or below the starting square; a diagonal step is defined as the movement of a piece from one chessboard to the chessboard immediately above or below the starting chessboard, in which the destination square shares a corner with the square on the destination chessboard that is directly above or below the starting square.

As set forth in further detail hereinbelow, kings, queens, princes, princesses and rooks may be moved in vertical leaps, although kings and princes are limited to one such leap (i.e., only to the chessboard immediately above or below the starting chessboard) in any single move. Kings, queens, princes, princesses and pawns may be moved in full-sided vertical steps, although pawns may be moved in such full-sided vertical steps only in a forward direction, and are limited to one such step in any single move (except upon each pawn's initial move), and kings and princes are also limited to one such step in any single move (albeit in any direction) at any time during the game. Kings, queens, princes, princesses, bishops and pawns may be moved in diagonal steps, although kings and princes may be moved only one such diagonal step in any single move, and a pawn may be moved in a diagonal step only in the act of capturing one of the pieces of the opposing player.

The rules set forth below for movement of the various chess pieces from one chessboard to another chessboard are subject to the limitations that no piece may be moved first in one direction vertically (e.g., upward) and then in the opposite direction vertically (e.g., downward) in a single move (i.e., a "bouncing" motion is not permitted), and that, as in traditional, two-dimensional chess, no piece (except the knight) may be moved in a manner which combines two or more different directions of movement (i.e., a "zig-zag" motion is not permitted either) . Moreover, in any single move no piece may be moved from one chessboard to another in a manner which combines two or more of the three different types of vertical movement (i.e., one or more vertical leaps may not be combined either with one or more diagonal steps or with one or more full-sided vertical steps, and one or more diagonal steps may not be combined with one or more full-sided vertical steps).

Bishops

In traditional, two-dimensional chess, a bishop may be moved horizontally, i.e., laterally within the confines of one chessboard, to a destination square that is of the same color as the square on which that particular bishop began play at the start of the game, and the same is true of the movements of a bishop from one chessboard to another in accordance with the invention. Furthermore, the movements and capturing moves of a bishop from one chessboard to another chessboard are limited to diagonal steps.

Specifically, a bishop may be moved from a starting chessboard to a destination chessboard that is either one level above or one level below the starting chessboard by taking a single diagonal step, either up or down, provided that the destination square is not occupied by a piece of the same color. A bishop may also be moved to a destination chessboard that is either more than one level above or more than one level below the starting chessboard by taking multiple diagonal steps, either up or down, provided that the final destination square is not occupied by a piece of the same color, and further provided that the intermediate square (s) is/are unoccupied (i.e., provided that the line of movement is unobstructed). Therefore, in the most preferred embodiment of the present invention, in which there are only three chessboards, a bishop is limited to a maximum of two diagonal steps (upward or downward) on any single move. In any case, if the final destination square is occupied by a piece of the opposing player, the movement described results in the capture of the opposing player's piece.

These movements of a bishop from one chessboard to another chessboard are illustrated by example in FIGS. 8A, 8B and 8C. Referring first to FIG. 8B, an illustrative bishop 60A, starting from square D3 on lowermost chessboard 11A, may be moved one diagonal step upward to any one of four possible destination squares C2, E2, C4 or E4 on intermediate chessboard 11B (and may capture a piece of the opposing player if situated thereon). Similarly, an illustrative bishop 60B, starting from square D3 on uppermost chessboard 11C, may be moved one diagonal step downward to any one of the same four possible destination squares on intermediate chessboard 11B (and likewise may capture a piece of the opposing player if situated thereon).

Also similarly, although not shown in the drawing, a bishop whose starting position is a square on intermediate chessboard 11B (e.g., the square designated by the numeral 61), may be moved one diagonal step downward to any one of a plurality of possible destination squares on lowermost chessboard 11A (e.g., to any one of the four possible destination squares designated by the numerals 62, 63, 64 or 65) (and may capture a piece of the opposing player if situated thereon), or it may be moved one diagonal step upward to any one of a plurality of possible destination squares on uppermost chessboard 11C (e.g., to any one of the four possible destination squares designated by the numerals 66, 67, 68 or 69) (and may likewise capture a piece of the opposing player if situated thereon).

As shown in FIG. 8A, an illustrative bishop 60C, also starting from square D3 on lowermost chessboard 11A, may be moved two diagonal steps upward to any one of the four possible destination squares B1, F1, F5 or B5 on uppermost chessboard 11C (and may capture a piece of the opposing player if situated thereon), passing respectively through one of the squares C2, E2, E4 or C4 (which must be unoccupied) on intermediate chessboard 11B. Similarly, as shown in FIG. 8C, an illustrative bishop 60D may also be moved two diagonal steps downward, e.g., from starting square C4 on uppermost chessboard 11C to any one of the four possible destination squares A2, E2, E6 or A6 on lowermost chessboard 11A (and may capture a piece of the opposing player if situated thereon), passing respectively through one of the squares B3, D3, D5, or B5 (which must be unoccupied) on intermediate chessboard 11B.

Pawns

In traditional, two-dimensional chess, each pawn may be moved horizontally, i.e., laterally within the confines of one chessboard, either one or two unoccupied squares forward, but only on its first move of the game, and thereafter only one unoccupied square forward on each of its subsequent moves during the remainder of the game, except that a pawn may capture opposing pieces (on any move of the game) only by moving forward and diagonally one square; all of the foregoing is also true of the movements of a pawn from one chessboard to another in accordance with the invention, regardless of the number of chessboards in the field of play.

Thus, a pawn may be moved on its first move of the game from a starting chessboard to a destination chessboard that is either one or two levels above, or one or two levels below, the starting chessboard, using either one or two full-sided vertical steps, either up or down. In any subsequent move of the game, a pawn may be moved to a destination chessboard that is either one level above or one level below the starting chessboard, using one full-sided vertical step, either up or down. In either case, the destination square must be unoccupied, and in the former case, if two full-sided vertical steps are taken, the intermediate square must also be unoccupied (i.e., the line of movement must be unobstructed). A pawn may also be moved to a destination chessboard that is either one level above or one level below the starting chessboard, using one diagonal step, either up or down, but only in the process of capturing one of the opposing player's pieces (i.e., in this case the destination square must be occupied by a chess piece of the other color). However, the movements and capturing moves of a pawn from one chessboard to another chessboard, as set forth in the preceding sentences, are subject to the limitation that, as in traditional, two-dimensional chess, a pawn may only be moved forward, that is, generally towards the opposite side of the apparatus 10, and specifically, for the pawns of one player, from an initial position in the second rank of one of the chessboards towards the eighth rank of any of the chessboards, and for the pawns of the other player, from an initial position, in the seventh rank of one of the chessboards towards the first rank of any of the chessboards.

These movements and capturing moves of pawns from one chessboard to another chessboard are illustrated by example in FIG. 9, but only for the pawns of one player (illustratively the white or lighter-colored pawns, and therefore these movements and capturing moves are permitted only when combined with lateral movement towards the eighth rank on any of the chessboards). An illustratively white pawn 70A, initially positioned at the start of a game, for example, on square A2 on lowermost chessboard 11A, may at any time thereafter, on its first move, be moved one full-sided vertical step upward, to destination square A3 on intermediate chessboard 11B (but only if that destination square is unoccupied). Also, an illustratively white pawn 70B that at the start of the game is initially positioned, for example, on square E2 of uppermost chessboard 11C, may at any time thereafter, but only on its first move, be moved two full-sided vertical steps downward, to destination square E4 on lowermost chessboard 11A (but only if that destination square is unoccupied), passing through the square E3 on intermediate chessboard 11B (which also must be unoccupied).

It is to be understood that in the alternative, pawn 70A (and any other white pawn that is positioned at the outset of a game on any square along the second rank of lowermost chessboard 11A) may optionally be initially moved two full-sided vertical steps upward, that is, to destination square A4 on uppermost chessboard 11C (provided that the latter is unoccupied). It should also be understood that pawn 70B (and any other white pawn that is initially positioned at the outset of a game on any square along the second rank of uppermost chessboard 11C) may optionally be initially moved only one full-sided vertical step downward, that is, to destination square E3 on intermediate chessboard 11B (provided that the latter is unoccupied), instead of the respective movements of pawns 70A and 70B that are actually illustrated in FIG. 9.

On any move other than its initial move, an illustrative white pawn 70C may be moved only one full-sided vertical step upward, e.g., from starting square A4 on lowermost chessboard 11A, to destination square A5 on intermediate chessboard 11B (provided that the latter is unoccupied). Although not shown in the drawings, it is to be understood that a white pawn that is not is not being moved for the first time during the course of a game, but whose starting position is a square on uppermost chessboard 11C (e.g., the square designated by the numeral 71 in FIG. 9), may be moved one full-sided vertical step downward to a destination square on intermediate chessboard 11B (e.g., to the square designated by the numeral 72 in FIG. 9, provided that it is unoccupied). Similarly, moves comprising only a single full-sided vertical step (either upward or downward) are available for a pawn situated on a square on intermediate chessboard 11B (since intermediate chessboard 11B is completely vacant at the start of a game, no pawn that is located on intermediate chessboard 11B can be experiencing its first move of that game). Thus, for example, a pawn starting from the square designated by the numeral 73 on intermediate chessboard 11B may be moved either to the destination square designated by the numeral 74 on uppermost chessboard 11C, or to the destination square designated by the numeral 75 on lowermost chessboard 11A, provided in each case that the destination square is unoccupied.

FIG. 9 also depicts one illustrative diagonal-step capturing move of a pawn. As shown therein, illustratively white pawn 70D, starting from square C4 on uppermost chessboard 11C, may be moved one diagonal step downward, to destination square D5 on intermediate chessboard 11B, provided that the destination square is occupied by one of the pieces of the opposing player (not shown), which would be captured in the process. Although not shown in the drawings, it is to be understood that similar single downward diagonal-step capturing moves are possible for a white pawn starting from a square on intermediate chessboard 11B, and that similar single upward diagonal-step capturing moves are possible for a white pawn starting from a square on either intermediate chessboard 11B or lowermost chessboard 11A. Further, as in traditional, two-dimensional chess, it is to be understood that a single diagonal-step capturing move is available even for a pawn that is being moved for the first time during the course a game (but such a capturing move would be upward only for the pawns in the conventional sets of standard chess pieces 37, 38 that are initially positioned on lowermost chessboard 11A, and would be downward only for the pawns in the supplemental sets of additional chess pieces 47, 48 that are initially positioned on uppermost chessboard 11C).

Although the movements and capturing moves of a pawn from one chessboard to another chessboard have been described hereinabove and are illustrated in FIG. 9 for pawns of one color only, it is to be understood that the movements and capturing moves from one chessboard to another chessboard of the pawns of the other color are similar, but are permitted only when combined with lateral movement in the opposite direction from that shown in FIG. 9 (i.e., towards the first rank on any of the chessboards).

With respect to pawn promotion (not shown), any pawn can be promoted on any chessboard. Thus, regardless of the chessboard on which a particular pawn is initially positioned and begins play, that pawn must be promoted when it reaches the end of a file on any chessboard. A pawn must be promoted even if it reaches the last square of a file on a particular chessboard by virtue of having been moved to that square from a starting position on a chessboard that is one level above, or one level below, the chessboard that includes the end-of-file destination square.

Also, the rules of traditional, two-dimensional chess relating to the capture by a pawn of an opposing player's pawn en passant apply to the multi-level version of the game of the present invention. Thus, for each pawn, if it is being moved for the first time during the course of a game, and if it is moved two full-sided vertical steps (either upward or downward as the case may be), and if a hostile pawn (i.e., a pawn of the opposing player) is situated so as to threaten the intermediate square through which the first pawn must pass (e.g., square E3 on intermediate chessboard 11B in FIG. 9 for pawn 70B), then on the opposing player's next move the hostile pawn (not shown) may be moved to that intermediate square, thereby intercepting and capturing the first pawn, as if the latter had been moved only one full-sided vertical step, rather than two.

Knights

In traditional, two-dimensional chess, a knight may be moved horizontally, i.e., laterally within the confines of one chessboard, in an L-shaped, 3-square movement, and the same is true of the movements of a knight from one chessboard to another chessboard in accordance with the invention, regardless of the number of chessboards in the field of play. However, the movements and capturing moves of a knight from one chessboard to another will differ, depending upon whether the knight is being moved to a destination chessboard that is either one level above or one level below the starting chessboard, or to a destination chessboard that is either two levels above or two levels below the starting chessboard.

In the former case, a knight may first be moved two squares horizontally (i.e., laterally) on the starting chessboard, in either direction along the rank, or in either direction along the file, that contains its starting square, to any one of four possible intermediate destination squares, and from there it may then be moved directly vertically, either upward to any one of four possible final destination squares, each of which corresponds in position to one of the intermediate destination squares but is located on the chessboard that is immediately above the starting chessboard, or downward to any one of four other possible final destination squares, each of which corresponds in position to one of the intermediate destination squares but is located on the chessboard that is immediately below the starting chessboard.

In the alternative, a knight may first be moved two levels directly vertically, to an intermediate destination square that corresponds in position to the starting square but which is located on a destination chessboard that is either two levels above or two levels below the starting chessboard, and from there it may then be moved one square horizontally (i.e., laterally) on the destination chessboard, in either direction along the rank, or in either direction along the file, that contains the intermediate destination square, to any one of four possible final destination squares on each of the two possible destination chessboards.

In either case, the movements of a knight may not include any vertical steps, and as in traditional, two-dimensional chess, the squares between the starting square and the final destination square need not be unoccupied (i.e., a knight may jump over pieces of its own color or pieces of the contrasting color in its movements and its capturing moves), although the final destination square either must be unoccupied or must be occupied by one of the pieces of the opposing player (the latter would then be captured as a result).

These movements of a knight from one chessboard to another chessboard are illustrated by example in FIGS. 12A and 12B of the drawings. As shown in FIG. 12B, a knight starting from a square on intermediate chessboard 11B can be moved to any one of four possible destination squares on uppermost chessboard 11C, or to any one of four possible destination squares on lowermost chessboard 11A (assuming that the selected destination square is not occupied by a piece of the same color). Specifically, an illustrative knight 76A, starting from square C4 on intermediate chessboard 11B, may be moved to any one of four possible final destination squares C2, E4, C6 or A4 on uppermost chessboard 11C (and may capture a piece of the opposing player if situated thereon), or to any one of four other possible final destination squares C2, E4, C6 or A4 on lowermost chessboard 11A (and may capture a piece of the opposing player if situated thereon), with knight 76A passing through one of the squares designated by the numerals 77, 78, 79 or 80, respectively (any of which may be occupied), and also passing through one of the intermediate destination squares designated by the numerals 81, 82, 83 or 84, respectively (any of which also may be occupied).

In a similar fashion, as shown in FIG. 12A an illustrative knight 76B may be moved from lowermost chessboard 11A to intermediate chessboard 11B, e.g., from starting square C3 on lowermost chessboard 11A, to any one of four possible final destination squares C1, E3, C5 or A3 on intermediate chessboard 11B (and may capture a piece of the opposing player if situated thereon), with knight 76B passing through one of the squares designated by the numerals 85, 86, 87 or 88, respectively (any of which may be occupied), and also passing through one of the intermediate destination squares designated by the numerals 89, 90, 91 or 92, respectively (any of which also may be occupied). Although not shown in the drawings, it should be understood that a knight may be moved in similar fashion from uppermost chessboard 11C to intermediate chessboard 11B, e.g., a knight starting from the square designated by the numeral 93 on uppermost chessboard 11C in FIG. 12A could be moved to any one of the same four final destination squares (C1, E3, C5 or A3) on intermediate chessboard 11B.

The other possible movements of a knight from one chessboard to another chessboard are also illustrated by example in FIG. 12A. Specifically, in addition to the movements described in the preceding paragraph, the illustrative knight 76B, starting from square C3 on lowermost chessboard 11A, may alternatively be moved two levels upward, to any one of four possible final destination squares C2, D3, C4 or B3 on uppermost chessboard 11C (and may capture a piece of the opposing player if situated thereon), with knight 76B passing through the square designated by the numeral 94 on intermediate chessboard 11B (which may be occupied), and also passing through the intermediate destination square designated by the numeral 93 on uppermost chessboard 11C (which also may be occupied). Similarly, an illustrative knight 76C, starting from square E5 on uppermost chessboard 11C, may be moved two levels downward, to any one of four possible final destination squares E4, F5, E6 or D5 on lowermost chessboard 11A (and may capture a piece of the opposing player if situated thereon), with knight 76C passing through the square designated by the numeral 95 on intermediate chessboard 11B (which may be occupied), and also passing through the intermediate destination square designated by the numeral 95*a* on lowermost chessboard 11A (which also may be occupied).

Rooks

In accordance with the invention, the movements and capturing moves of a rook from one chessboard to another chessboard are limited to vertical leaps. Specifically, a rook may be moved to the corresponding square on a destination chessboard that is either one level above or one level below the starting chessboard by taking a single vertical leap, either up or down, provided that the destination square is not occupied by a piece of the same color. A rook may also be moved to the corresponding square on a destination chessboard that is either more than one level above or more than one level below the starting chessboard by taking multiple vertical leaps, either up or down, provided that the final destination square is not occupied by a piece of the same color, and further provided that the corresponding intermediate square(s) is/are unoccupied (i.e., provided that the line of movement is unobstructed). Therefore, in the most preferred embodiment of the present invention, in which there are only three chessboards, a rook is limited to a maximum of two vertical leaps (upward or downward) on any single move. In any case, if the destination square is occupied by a piece of the opposing player, the movement described results in the capture of the opposing player's piece.

These movements of a rook from one chessboard to another are illustrated by example in FIG. 11. As shown therein, an illustrative rook 96A, starting from square D3 on intermediate chessboard 11B, may be moved either upward one level, using a single vertical leap, to destination square D3 on uppermost chessboard 11C (and may capture a piece of the opposing player if situated thereon), or may be moved downward one level, also using a single vertical leap, to destination square D3 on lowermost chessboard 11A (and may likewise capture a piece of the opposing player if situated thereon). Similarly, an illustrative rook 96B, starting from square A1 on lowermost chessboard 11A, may be moved upward one level, using a single vertical leap, to destination square A1 on intermediate chessboard 11B (and may capture a piece of the opposing player if situated thereon), and an illustrative rook 96C, starting from square H1 on uppermost chessboard 11C, may be moved downward one level, using a single vertical leap, to destination square H1 on intermediate chessboard 11B (and may capture a piece of the opposing player if situated thereon).

Also as shown in FIG. 11, an illustrative rook 96D, starting from square A2 on lowermost chessboard 11A, may be moved upward two levels, using two vertical leaps, to destination square A2 on uppermost chessboard 11C (and may capture a piece of the opposing player if situated thereon), passing through the square on intermediate chessboard 11B that is designated by the numeral 97 (which must be unoccupied). Similarly, an illustrative rook 96E, starting from square A4 on uppermost chessboard 11C, may be moved downward two levels, using two vertical leaps, to destination square A4 on lowermost chessboard 11A (and may capture a piece of the opposing player if situated thereon), passing through the square on intermediate chessboard 11B that is designated by the numeral 98 (which must be unoccupied).

Queens and Princesses

In the most preferred embodiment of the present invention, there are two queens and two princesses (one of each color). As stated hereinabove, in accordance with the invention a queen or a princess may be moved horizontally, i.e., laterally, from one square to another square within the confines of one chessboard, as a bishop or as a rook, and the same is also true of the movements of a queen and of a princess from one chessboard to another chessboard in accordance with the invention; however, a queen and a princess may make other step-wise moves as well. Thus, a queen or a princess may be moved any number of levels either upward or downward, in vertical leaps, or in diagonal steps, or in full-sided vertical steps, in any direction, provided that the line of movement is unobstructed, and provided further that the final destination square is not occupied by a piece of the same color (if the final destination square is occupied by a piece of the other color, a capture of that piece results). Therefore, in the most preferred embodiment of the present invention, in which there are only three chessboards, a queen and a princess, like a rook, are limited to a maximum of two vertical leaps (either upward or downward) on any single move, and like a bishop, they are limited to a maximum of two diagonal steps (either upward or downward) on any single move; in addition, they are limited to a maximum of two full-sided vertical steps (either upward or downward) on any single move.

These movements are illustrated by example in FIGS. 13A and 13B. Although FIGS. 13A and 13B illustrate only the movements and capturing moves of a queen, it is to be understood that those same drawing figures are also illustrative of the movements and capturing moves of a princess, despite the fact that the latter piece is not explicitly depicted therein.

As shown in FIG. 13B, an illustrative queen 99A, starting from square B1 on lowermost chessboard 11A, may be moved upward one level, using a single vertical leap, to the corresponding square on the adjacent chessboard, i.e., to destination square B1 on intermediate chessboard 11B (and may capture a piece of the opposing player if situated thereon). Similarly, an illustrative queen 99B, starting from square A1 on intermediate chessboard 11B, may be moved upward one level, using a single vertical leap, to destination square A1 on uppermost chessboard 11C (and may capture a piece of the opposing player if situated thereon).

In similar fashion, an illustrative queen 99C, starting from square F3 on intermediate chessboard 11B, may be moved downward one level, using a single vertical leap, to destination square F3 on lowermost chessboard 11A (and may capture a piece of the opposing player if situated thereon), and an illustrative queen 99D (see FIG. 13A), starting from square F3 on uppermost chessboard 11C, may be moved downward one level, using a single vertical leap, to destination square F3 on intermediate chessboard 11B (and may capture a piece of the opposing player if situated thereon).

The movements and capturing moves of a queen from one chessboard to another which involve vertical leaps, as described in the preceding paragraph and as depicted in FIGS. 13A and 13B, can be extended further, as illustrated in FIG. 13A. Specifically, as shown therein, an illustrative queen 99E, starting from square A1 on uppermost chessboard 11C, may be moved downward, using two vertical leaps, to the corresponding square on the destination chessboard that is two levels below the starting chessboard, i.e., to square A1 on lowermost chessboard 11A (and may capture a piece of the opposing player if situated thereon), with queen 99E passing through the square on intermediate chessboard 11B that is designated by the numeral 100 (which must be unoccupied). Similarly, an illustrative queen 99F, starting from square F5 on lowermost chessboard 11A, may be moved upward two levels, using two vertical leaps, to destination square F5 on uppermost chessboard 11C (and may capture a piece of the opposing player if situated thereon), with queen 99F passing through the square on intermediate chessboard 11B that is designated by the numeral 101 (which must be unoccupied).

FIGS. 13A and 13B also depict some of the movements of a queen from one chessboard to another that involve vertical steps. Specifically, an illustrative queen 99G, starting from square B3 on lowermost chessboard 11A (in FIG. 13A), may be moved upward one level, using a single diagonal step, to any one of four possible destination squares A2, C2, C4 or A4 on intermediate chessboard 11B (and may capture a piece of the opposing player if situated thereon), or queen 99G may alternatively be moved upward one level, using a single full-sided vertical step, to any one of four other possible destination squares B2, C3, B4 or A3, also on intermediate chessboard 11B (and may capture a piece of the opposing player if situated thereon).

Although not shown in the drawings, it should also be understood that a queen may be moved upward one level, in similar fashion, from intermediate chessboard 11B, to a plurality of possible destination squares on uppermost chessboard 11C, using either a single diagonal step or a single full-sided vertical step, and that similar downward movements and capturing moves are possible for a queen from intermediate chessboard 11B to lowermost chessboard 11A, and from uppermost chessboard 11C to intermediate chessboard 11B. For example, a queen (not shown), starting from the square on uppermost chessboard 11C that is designated by the numeral 102, could be moved downward one level to any one of the eight previously-mentioned possible destination squares on intermediate chessboard 11B (i.e., to any one of squares A2, B2, C2, C3, C4, B4, A4, A3 or A2 on that chessboard).

The movements and capturing moves of a queen from one chessboard to another which involve diagonal steps and full-sided vertical steps, as described in the preceding paragraphs and as depicted in FIG. 13A, can be extended further, as illustrated in FIG. 13B. Specifically, as shown therein, an illustrative queen 99H, starting from square C3 on lowermost chessboard 11A, may be moved upward two levels, using two diagonal steps, to any one of four possible destination squares A1, E1, E5 or A5 on uppermost chessboard 11C (and may capture a piece of the opposing player if situated thereon), with queen 99H passing through one of the squares on intermediate chessboard 11B that is designated by the numerals 103, 104, 105 or 106, respectively (which must be unoccupied), or queen 99H may alternatively be moved upward two levels, using two full-sided vertical steps, to any one of four other possible destination squares C1, E3, C5 or A3, also on uppermost chessboard 11C (and may capture a piece of the opposing player if situated thereon), with queen 99H passing through one of the squares on intermediate chessboard 11B that is designated by the numerals 107, 108, 109 or 110, respectively (which likewise must be unoccupied).

Although not shown in the drawings, it should also be understood that similar downward movements and capturing moves are possible for a queen, from uppermost chessboard 11C to lowermost chessboard 11A. For example, a queen (not shown), starting from the square on uppermost chessboard 11C that is designated by the numeral 111 (in FIG. 13A), could be moved downward two levels, using two diagonal steps or two full-sided vertical steps (as the case may be), to any one of the eight possible destination squares on lowermost chessboard 11A that are designated by the numerals 112, 113, 114, 115, 116, 117, 118 or 119, with that queen (not shown) passing in each case through a square (not designated) on intermediate chessboard 11B (which must be unoccupied).

Kings and Princes

In the most preferred embodiment of the present invention, there are two kings and two princes. As stated hereinabove, in accordance with the invention a king or a prince may be moved horizontally, i.e., laterally, from one square to another square within the confines of one chessboard, in directions similar to that of the queen but limited to only one open square in any single move, and the same is also true of the movements and capturing moves of a king and of a prince from one chessboard to another chessboard in accordance with the invention. Thus, a king or a prince may be moved to a destination chessboard that is either one level above or one level below the starting chessboard, in a vertical leap, or in a diagonal step, or in a full-sided vertical step, in any direction, provided that the destination square is not occupied by a piece of the same color (if the destination square is occupied by any piece of the other color except its king, a capture of that piece results), and provided further, but only with respect to a king, that as in traditional, two-dimensional chess, the movement does not result in placing the king in check.

These movements are illustrated by example in FIG. 10. Although as mentioned hereinabove there is a need to distinguish between a king and a prince for purposes of capture threats directed against them by the hostile forces of the opposing player (since a game would continue even if either player's prince were captured), nevertheless there is no need to distinguish between a king and a prince for purposes of describing the movements and capturing moves that may be made with them. For the latter purposes, a king and a prince are equivalent, and therefore, although FIG. 10 illustrates only the movements and capturing moves of a king, it is to be understood that that same drawing figure is also illustrative of the movements and capturing moves of a prince, despite the fact that the latter piece is not explicitly depicted therein.

As shown in FIG. 10, an illustrative king 120A, starting from square D1 on lowermost chessboard 11A, may be moved upward one level, using a single vertical leap, to a destination square on intermediate chessboard 11B that corresponds in position to the starting square (i.e., to square D1 on intermediate chessboard 11B) (and may capture a piece of the opposing player if situated thereon). Similarly, an illustrative king 120B, starting from square B1 on intermediate chessboard 11B, may be moved upward one level, using a single vertical leap, to the corresponding destination square B1 on uppermost chessboard 11C (and may capture a piece of the opposing player if situated thereon). In a similar fashion, an illustrative king 120C, starting from square C1 on uppermost chessboard 11C, may be moved downward one level, using a single vertical leap, to the corresponding destination square (C1) on intermediate chessboard 11B (and may capture a piece of the opposing player if situated thereon), and an illustrative king 120D, starting from square A1 of intermediate chessboard 11B, may be moved downward one level, using a single vertical leap, to the corresponding destination square (A1) on lowermost chessboard 11A (and may capture a piece of the opposing player if situated thereon).

FIG. 10 also depicts some of the movements of a king from one chessboard to another that involve vertical steps. specifically, an illustrative king 120E, starting from square C4 on lowermost chessboard 11A, may be moved upward one level, using a single diagonal step, to any one of four possible destination squares B3, D3, D5, or B5 on intermediate chessboard 11B (and may capture a piece of the opposing player if situated thereon), or king 120E may alternatively be moved upward one level, using a single full-sided vertical step, to any one of four other possible destination squares C3, D4, C5 or B4, also on intermediate chessboard 11B (and may capture a piece of the opposing player if situated thereon). Although not shown in the drawings, it should be understood that similar upward movements and capturing moves are also possible for a king (not shown) from a starting square on intermediate chessboard 11B (e.g., from the square designated by the numeral 121 on that chessboard) to a plurality of possible destination squares on uppermost chessboard 11C, using either a single diagonal step or a single full-sided vertical step.

In addition, an illustrative king 120F, starting from square H3 on uppermost chessboard 11C, may be moved downward one level, using a single diagonal step, to either of two possible destination squares G2 or G4 on intermediate chessboard 11B (and may capture a piece of the opposing player if situated thereon), or king 120F may alternatively be moved downward one level, using a single full-sided vertical step, to any one of three other possible destination squares H2, G3 or H4, also on intermediate chessboard 11B (and may capture a piece of the opposing player if situated thereon). Although not shown in the drawings, it should be understood that similar downward movements and capturing moves are also possible for a king (not shown) from a starting square on intermediate chessboard 11B (e.g., from the square designated by the numeral 121 on that chessboard) to a plurality of possible destination squares on lowermost chessboard 11A, using either a single diagonal step or a single full-sided vertical step.

Although the rules described above are preferred for governing the movements and capturing moves of the various pieces, it is to be understood that many variations thereof are possible. For example, additional offensive capability can be introduced if the movements and capturing moves of the princes are adjusted so that they are the same as the movements and capturing moves of the princesses and queens. The offensive capability can be reduced, on the other hand, by not allowing pawns to be promoted to queens (except perhaps for the first pawn of each color to be promoted during the course of a game), but by instead allowing pawns to be promoted only to princes (whose movements and capturing moves in this case would not be the same as those of the queens and princesses, but would be the same as those of the kings, as described hereinabove).

Although the movements and capturing moves of the various pieces have been described hereinabove and are illustrated in the drawings in detail only with respect to the most preferred embodiment of the invention, in which there are only three chessboards and only one pair of supplemental sets of additional chess pieces, it should be understood that the concepts of the invention can be extended, mutatis mutandis, to other embodiments of the invention in which more than three chessboards and more than one pair of supplemental sets of additional chess pieces are involved, but that the movements and capturing moves of the various chess pieces will differ somewhat in those other embodiments.

For example, in an alternative but still preferred embodiment of the invention, in which there are five chessboards and two pairs of supplemental sets of additional chess pieces, preferably the pair of conventional sets of standard chess pieces would be positioned initially on the lowermost chessboard, while one pair of supplemental sets of additional chess pieces would be positioned initially on the chessboard that is two levels above the lowermost chessboard (i.e., on the third chessboard) and the other pair of supplemental sets of additional chess pieces would be positioned initially on the chessboard that is two levels above that (i.e., on the fifth chessboard, which is also the uppermost chessboard). If desired, however, the sets of chess pieces could be interchanged, such that the pair of conventional sets of standard chess pieces would be positioned initially on either the third chessboard or on the fifth (i.e., the uppermost) chessboard, simply by interchanging the initial positions of the king and queen of one or both players with one of the prince/princess pairs of the respective player(s). In any event, in this embodiment of the invention the second and fourth chessboards would initially be vacant of chess pieces at the outset of the game.

In this five-chessboard embodiment of the invention, the rules for play, including the movements and capturing moves of all of the pieces, would be essentially identical to those set forth hereinabove for the most preferred embodiment, except that (assuming unobstructed lines of movement) the rooks, queens and princesses would be limited to a maximum of four vertical leaps, upward or downward, in any single move, the bishops, queens and princesses would be limited to a maximum of four diagonal steps, upward or downward, in any single move, and the queens and princesses would also be limited to a maximum of four full-sided vertical steps, upward or downward, in any single move, all due to the fact that there are five chessboards instead of three. It will be evident that the aforesaid limits on the maximum number of each type of vertical movement for the chess pieces mentioned will increase by two as the number of chessboards is also increased by two (e.g., to seven chessboards, nine chessboards, etc.) to form other embodiments of the present invention.

An optional enhancement for all of the embodiments of the present invention in which the chessboards are stacked vertically, one above the other, is the provision of storage means. Although as mentioned hereinabove, it is contemplated that the arranging means will be adapted to permit easy assembly of the game apparatus when it is needed for play, and easy disassembly thereof when play is completed, nevertheless it may be desirable in certain instances to store the game apparatus without disassembly. In these instances, or if the game apparatus is provided as a permanently assembled structure, the game apparatus may also include removable storage means, preferably in the form of removable drawers, in which the playing pieces (or any other objects of appropriate size) could be stowed for later use.

Illustratively, and as shown in phantom lines in FIG. 6 of the drawings in conjunction with the most preferred embodiment of the present invention, the storage means would preferably take the form of at least one drawer 122, of sufficient height and depth to be removably placed between intermediate chessboard 11B and uppermost chessboard 11C, with intermediate chessboard 11B providing the necessary support. As shown in FIG. 6, drawer 122 may optionally be provided with opening and closing means, illustratively comprising a handle 123. Similarly, although not shown in the drawings, storage means could be provided for removable placement between lowermost chessboard 11A and intermediate chessboard 11B. As will be evident to those skilled in the art, the storage means would be completely removed from the game apparatus 10 when it is being used to play a game.

Although the invention has thus far been described only with respect to physical (i.e., mechanical, real-world) implementations of the various embodiments thereof, it is to be understood that it is within the scope of the present invention also to provide corresponding electronic implementations thereof for use on programmable digital computers and other microprocessor-based electronic devices. Electronic implementations of the traditional, two-dimensional game of chess have been known for more than twenty years, and it is well within the skill of the programming art to adapt those implementations to the various embodiments of the present invention.

While there has been described what are at present considered to be the preferred embodiments of the present invention, it will be apparent to those skilled in the art that the embodiments described herein are by way of illustration and not of limitation, and that various changes and modifications may be made therein without departing from the true spirit and scope of the present invention, as set forth in the appended claims.

I claim:

1. A multi-level chess game apparatus for three-dimensional play, comprising:

an odd-numbered plurality of chessboards;

means for arranging said plurality of chessboards in vertical spaced relation to one another;

a pair of conventional sets of standard chess pieces, each member of said pair having means for visual differentiation from the other member of said pair, each of said conventional sets of standard chess pieces comprising eight conventional protective pieces and eight conventional royalty pieces, said eight conventional protective pieces comprising eight pawns and said eight conventional royalty pieces comprising two knights, two bishops, two rooks, a queen and a king, said conventional sets of standard chess pieces being initially positioned opposite one another in standard fashion on the first of said plurality of chessboards; and at least one pair of supplemental sets of additional chess pieces, each member of said at least one pair having means for visual differentiation from the other member of said at least one pair, the number of said supplemental sets of additional chess pieces being an even number that is one integer less than the number of said plurality of chessboards, each of said supplemental sets of additional chess pieces consisting of eight additional protective pieces and eight additional royalty pieces, each pair of said at least one pair of supplemental sets of additional chess pieces being initially positioned in standard fashion such that one member of each said pair is positioned opposite the other member of said pair on an odd-numbered one of said chessboards other than the first of said plurality of chessboards.

2. The apparatus of claim 1 wherein said chessboards are substantially identical.

3. The apparatus of claim 2 wherein said chessboards are oriented in congruent relation to one another.

4. The apparatus of claim 3 wherein in each of said supplemental sets of additional chess pieces the movements and capturing moves of each of said eight additional protective pieces on each one of said chessboards and from one of said chessboards to another one of said chessboards are governed by the same rules as govern the movements and capturing moves of a pawn on each one of said chessboards and from one of said chessboards to another one of said chessboards, the movements and capturing moves of a first additional royalty piece and a second additional royalty piece on each one of said chessboards and from one of said chessboards to another one of said chessboards are governed by the same rules as govern the movements and capturing moves of a knight on each one of said chessboards and from one of said chessboards to another one of said chessboards, the movements and capturing moves of a third additional royalty piece and a fourth additional royalty piece on each one of said chessboards and from one of said chessboards to another one of said chessboards are governed by the same rules as govern the movements and capturing moves of a bishop on each one of said chessboards and from one of said chessboards to another one of said chessboards, the movements and capturing moves of a fifth additional royalty piece and a sixth additional royalty piece on each one of said chessboards and from one of said chessboards to another one of said chessboards are governed by the same rules as govern the movements and capturing moves of a rook on each one of said chessboards and from one of said chessboards to another one of said chessboards, the movements and capturing moves of a seventh additional royalty piece on each one of said chessboards and from one of said chessboards to another one of said chessboards are governed by the same rules as govern the movements and capturing moves of a queen on each one of said chessboards and from one of said chessboards to another one of said chessboards, and the movements and capturing moves of an eighth additional royalty piece on each one of said chessboards and from one of said chessboards to another one of said chessboards are governed by the same rules as govern the movements and capturing moves of a king on each one of said chessboards and from one of said chessboards to another one of said chessboards except that said eighth additional royalty piece may not experience castling.

5. The apparatus of claim 4 wherein in each of said supplemental sets of additional chess pieces each of said eight additional protective pieces initially occupies a position corresponding to the initial position of a pawn in a conventional set of standard chess pieces, and each of said eight additional royalty pieces initially occupies a position corresponding to the initial position in a conventional set of standard chess pieces of the one of said eight conventional royalty pieces whose movements and capturing moves on each of said chessboards and from one of said chessboards to another of said chessboards are governed by the same rules.

6. The apparatus of claim 3 wherein in each of said supplemental sets of additional chess pieces said eight additional protective pieces comprise eight additional pawns, and said eight additional royalty pieces comprise a first additional royalty piece, a second additional royalty piece, two additional knights, two additional bishops and two additional rooks.

7. The apparatus of claim 6 wherein in each of said supplemental sets of additional chess pieces each of said eight additional pawns initially occupies a position corresponding to the initial position of a pawn in a conventional set of standard chess pieces, each of said two additional knights initially occupies a position corresponding to the initial position of a knight in a conventional set of standard chess pieces, each of said two additional bishops initially occupies a position corresponding to the initial position of a bishop in a conventional set of standard chess pieces, each of said two additional rooks initially occupies a position corresponding to the initial position of a rook in a conventional set of standard chess pieces, said first additional royalty piece initially occupies a position corresponding to the initial position of a queen in a conventional set of standard chess pieces, and said second additional royalty piece initially occupies a position corresponding to the initial position of a king in a conventional set of standard chess pieces.

8. The apparatus of claims 6 or 7 wherein in each of said supplemental sets of additional chess pieces the movements and capturing moves of said first additional royalty piece on each one of said chessboards and from one of said chessboards to another one of said chessboards are governed by the same rules as govern the movements and capturing moves of a queen on each one of said chessboards and from one of said chessboards to another one of said chessboards, and the movements and capturing moves of said second additional royalty piece on each one of said chessboards and from one of said chessboards to another one of said chessboards are governed by the same rules as govern the movements and capturing moves of a king on each one of said chessboards and from one of said chessboards to another one of said chessboards except that said second additional royalty piece may not experience castling.

9. The apparatus of claim 8 wherein all except the first of said plurality of chessboards are substantially transparent.

10. The apparatus of claim 9 wherein said plurality of chessboards comprises fewer than eight chessboards.

11. The apparatus of claim 10 wherein said plurality of chessboards comprises three chessboards.

12. The apparatus of claim 11 wherein said first of said plurality of chessboards is the lowermost of said plurality of chessboards.

13. The apparatus of claim 12 wherein said visual differentiation means comprises contrasting colorations.

14. The apparatus of claim 13 wherein said contrasting colorations are black and white.

15. A multi-level chess game apparatus for three-dimensional play, comprising:

first, second and third chessboards;

means for arranging said chessboards in vertical spaced relation to one other;

a pair of conventional sets of standard chess pieces, each member of said pair having means for visual differentiation from the other member of said pair, each of said conventional sets of standard chess pieces comprising eight conventional protective pieces and eight conventional royalty pieces, said eight conventional protective pieces comprising eight pawns and said eight conventional royalty pieces comprising two knights, two bishops, two rooks, a queen and a king, said conventional sets of standard chess pieces being initially positioned opposite one another in standard fashion on said first chessboard; and a pair of supplemental sets of additional chess pieces, each member of said pair having means for visual differentiation from the other member of said pair, each of said supplemental sets of additional chess pieces consisting of eight additional protective pieces and eight additional royalty pieces, said supplemental sets of additional chess pieces being initially positioned opposite one another in standard fashion on said third chessboard.

16. The apparatus of claim 15 wherein said chessboards are substantially identical.

17. The apparatus of claim 16 wherein said chess boards are oriented in congruent relation to one another.

18. The apparatus of claim 17 wherein in each of said supplemental sets of additional chess pieces the movements and capturing moves of each of said eight additional protective pieces on each one of said chessboards and from one of said chessboards to another one of said chessboards are governed by the same rules as govern the movements and capturing moves of a pawn on each one of said chessboards and from one of said chessboards to another one of said chessboards, the movements and capturing moves of a first additional royalty piece and a second additional royalty piece on each one of said chessboards and from one of said chessboards to another one of said chessboards are governed by the same rules as govern the movements and capturing moves of a knight on each one of said chessboards and from one of said chessboards to another one of said chessboards, the movements and capturing moves of a third additional royalty piece and a fourth additional royalty piece on each one of said chessboards and from one of said chessboards to another one of said chessboards are governed by the same rules as govern the movements and capturing moves of a bishop on each one of said chessboards and from one of said chessboards to another one of said chessboards, the movements and capturing moves of a fifth additional royalty piece and a sixth additional royalty piece on each one of said chessboards and from one of said chessboards to another one of said chessboards are governed by the same rules as govern the movements and capturing moves of a rook on each one of said chessboards and from one of said chessboards to another one of said chessboards, the movements and capturing moves of a seventh additional royalty piece on each one of said chessboards and from one of said chessboards to another one of said chessboards are governed by the same rules as govern the movements and capturing moves of a queen on each one of said chessboards and from one of said chessboards to another one of said chessboards, and the movements and capturing moves of an eighth additional royalty piece on each one of said chessboards and from one of said chessboards to another one of said chessboards are governed by the same rules as govern the movements and capturing moves of a king on each one of said chessboards and from one of said chessboards to another one of said chessboards except that said eighth additional royalty piece may not experience castling.

19. The apparatus of claim 18 wherein in each of said supplemental sets of additional chess pieces each of said eight additional protective pieces initially occupies a position corresponding to the initial position of a pawn in a conventional set of standard chess pieces, and each of said eight additional royalty pieces initially occupies a position corresponding to the initial position in a conventional set of standard chess pieces of the one of said eight conventional royalty pieces whose movements and capturing moves on each of said chessboards and from one of said chessboards to another of said chessboards are governed by the same rules.

20. The apparatus of claim 17 wherein in each of said supplemental sets of additional chess pieces said eight additional protective pieces comprise eight additional pawns, and said eight additional royalty pieces comprise two additional knights, two additional bishops, two additional rooks, an additional royalty piece denominated a prince, and an additional royalty piece denominated a princess.

21. The apparatus of claim 20 wherein in each of said supplemental sets of additional chess pieces each of said eight additional pawns initially occupies a position corresponding to the initial position of a pawn in a conventional set of standard chess pieces, each of said two additional knights initially occupies a position corresponding to the initial position of a knight in a conventional set of standard chess pieces, each of said two additional bishops initially occupies a position corresponding to the initial position of a bishop in a conventional set of standard chess pieces, each of said two additional rooks initially occupies a position corresponding to the initial position of a rook in a conventional set of standard chess pieces, said prince initially occupies a position corresponding to the initial position of a king in a conventional set of standard chess pieces, and said princess initially occupies a position corresponding to the initial position of a queen in a conventional set of standard chess pieces.

22. The apparatus of claims 20 or 21 wherein in each of said supplemental sets of additional chess pieces the movements and capturing moves of said prince on each one of said chessboards and from one of said chessboards to another one of said chessboards are governed by the same rules as govern the movements and capturing moves of a king on each one of said chessboards and from one of said chessboards to another one of said chessboards except that said prince may not experience castling, and the movements and capturing moves of said princess on each one of said chessboards and from one of said chessboards to another one of said chessboards are governed by the same rules as govern the movements and capturing moves of a queen on each one of said chessboards and from one of said chessboards to another one of said chessboards.

23. The apparatus of claim 22 wherein at least two of said chessboards are substantially transparent.

24. The apparatus of claim 23 wherein said first chessboard is the lowermost of said chessboards and said third chessboard is the uppermost of said chessboards.

25. The apparatus of claim 24 wherein said second chessboard and said third chessboard are substantially transparent.

26. The apparatus of claim 25 wherein said visual differentiation means comprises contrasting colorations.

27. The apparatus of claim 26 wherein said contrasting colorations are black and white.

28. A programmable electronic digital apparatus comprising (a) digital storage means, (b) digital input means, (c) output means comprising a display, and (d) digital programming means capable of depicting on said display a multilevel chess game for three-dimensional play, said chess game comprising:

an odd-numbered plurality of chessboards;

a pair of conventional sets of standard chess pieces, each member of said pair having means for visual differentiation from the other member of said pair, each of said conventional sets of standard chess pieces comprising eight conventional protective pieces and eight conventional royalty pieces, said eight conventional protective pieces comprising eight pawns and said eight conventional royalty pieces comprising two knights, two bishops, two rooks, a queen and a king, said conventional sets of standard chess pieces being initially positioned opposite one another in standard fashion on the first of said plurality of chessboards; and at least one pair of supplemental sets of additional chess pieces, each member of said at least one pair having means for visual differentiation from the other member of said at least one pair, the number of said supplemental sets of additional chess pieces being an even number that is one integer less than the number of said plurality of chessboards, each of said supplemental sets of additional chess pieces consisting of eight additional protective pieces and eight additional royalty pieces, each pair of said at least one pair of supplemental sets of additional chess pieces being initially positioned in standard fashion such that one member of each said pair is positioned opposite the other member of said pair on an odd-numbered one of said chessboards other than the first of said plurality of chessboards;

said digital programming means further being capable of depicting on said display the movements and capturing moves of said chess pieces in response to commands received through said input means and in accordance with a set of predetermined rules stored in said storage means and governing said movements and capturing moves.

29. The apparatus of claim 28 wherein said chessboards are substantially identical.

30. The apparatus of claim 29 wherein in each of said supplemental sets of additional chess pieces the movements and capturing moves of each of said eight additional protective pieces on each one of said chessboards and from one of said chessboards to another one of said chessboards are governed by the same rules as govern the movements and capturing moves of a pawn on each one of said chessboards and from one of said chessboards to another one of said chessboards, the movements and capturing moves of a first additional royalty piece and a second additional royalty piece on each one of said chessboards and from one of said chessboards to another one of said chessboards are governed by the same rules as govern the movements and capturing moves of a knight on each one of said chessboards and from one of said chessboards to another one of said chessboards, the movements and capturing moves of a third additional royalty piece and a fourth additional royalty piece on each one of said chessboards and from one of said chessboards to another one of said chessboards are governed by the same rules as govern the movements and capturing moves of a bishop on each one of said chessboards and from one of said chessboards to another one of said chessboards, the movements and capturing moves of a fifth additional royalty piece and a sixth additional royalty piece on each one of said chessboards and from one of said chessboards to another one of said chessboards are governed by the same rules as govern the movements and capturing moves of a rook on each one of said chessboards and from one of said chessboards to another one of said chessboards, the movements and capturing moves of a seventh additional royalty piece on each one of said chessboards and from one of said chessboards to another one of said chessboards are governed by the same rules as govern the movements and capturing moves of a queen on each one of said chessboards and from one of said chessboards to another one of said chessboards, and the movements and capturing moves of an eighth additional royalty piece on each one of said chessboards and from one of said chessboards to another one of said chessboards are governed by the same rules as govern the movements and capturing moves of a king on each one of said chessboards and from one of said chessboards to another one of said chessboards except that said eighth additional royalty piece may not experience castling.

31. The apparatus of claim 30 wherein in each of said supplemental sets of additional chess pieces each of said eight additional protective pieces initially occupies a position corresponding to the initial position of a pawn in a conventional set of standard chess pieces, and each of said eight additional royalty pieces initially occupies a position corresponding to the initial position in a conventional set of standard chess pieces of the one of said eight conventional royalty pieces whose movements and capturing moves on each of said chessboards and from one of said chessboards to another of said chessboards are governed by the same rules.

32. The apparatus of claim 29 wherein in each of said supplemental sets of additional chess pieces said eight additional protective pieces comprise eight additional pawns, and said eight additional royalty pieces comprise a first additional royalty piece, a second additional royalty piece, two additional knights, two additional bishops and two additional rooks.

33. The apparatus of claim 32 wherein in each of said supplemental sets of additional chess pieces each of said eight additional pawns initially occupies a position corresponding to the initial position of a pawn in a conventional set of standard chess pieces, each of said two additional knights initially occupies a position corresponding to the initial position of a knight in a conventional set of standard chess pieces, each of said two additional bishops initially occupies a position corresponding to the initial position of a bishop in a conventional set of standard chess pieces, each of said two additional rooks initially occupies a position corresponding to the initial position of a rook in a conventional set of standard chess pieces, said first additional royalty piece initially occupies a position corresponding to the initial position of a queen in a conventional set of standard chess pieces, and said second additional royalty piece initially occupies a position corresponding to the initial position of a king in a conventional set of standard chess pieces.

34. The apparatus of claims 32 or 33 wherein in each of said supplemental sets of additional chess pieces the movements and capturing moves of said first additional royalty piece on each one of said chessboards and from one of said chessboards to another one of said chessboards are governed by the same rules as govern the movements and capturing moves of a queen on each one of said chessboards and from one of said chessboards to another one of said chessboards, and the movements and capturing moves of said second additional royalty piece on each one of said chessboards and from one of said chessboards to another one of said chessboards are governed by the same rules as govern the movements and capturing moves of a king on each one of said chessboards and from one of said chessboards to another one of said chessboards except that said second additional royalty piece may not experience castling.

35. The apparatus of claim 34 wherein said plurality of chessboards comprises fewer than eight chessboards.

36. The apparatus of claim 35 wherein said plurality of chessboards comprises three chessboards.

37. The apparatus of claim 36 wherein said visual differentiation means comprises contrasting colorations.

38. A method of enabling the playing of a multi-level chess game, said method comprising the steps of:

(a) providing an odd-numbered plurality of chessboards;

(b) arranging said plurality of chessboards in vertical spaced relation to one another;

(c) providing a pair of conventional sets of standard chess pieces, each member of said pair having means for visual differentiation from the other member of said pair, each of said conventional sets of standard chess pieces comprising eight conventional protective pieces and eight conventional royalty pieces, said eight conventional protective pieces comprising eight pawns and said eight conventional royalty pieces comprising two knights, two bishops, two rooks, a queen and a king, said conventional sets of standard chess pieces being initially positioned opposite one another in standard fashion on the first of said plurality of chessboards;

(d) providing at least one pair of supplemental sets of additional chess pieces, each member of said at least one pair having means for visual differentiation from the other member of said at least one pair, the number of said supplemental sets of additional chess pieces being an even number that is one integer less than the number of said plurality of chessboards, each of said supplemental sets of additional chess pieces consisting of eight additional protective pieces and eight additional royalty pieces, each pair of said at least one pair of supplemental sets of additional chess pieces being initially positioned in standard fashion such that one member of each said pair is positioned opposite the other member of said pair on an odd-numbered one of said chessboards other than the first of said plurality of chessboards; and (e) providing a set of predetermined rules to govern the movements and capturing moves from one of said chessboards to another one of said chessboards of each chess piece in said conventional sets of standard chess pieces, and to govern the movements and capturing moves on each one of said chessboards and from one of said chessboards to another one of said chessboards of each chess piece in said supplemental sets of additional chess pieces.

39. The method of claim 38 wherein said chessboards are substantially identical.

40. The method of claim 39 wherein said chessboards are oriented in congruent relation to one another.

41. The method of claim 40 wherein said rules specify that in each of said supplemental sets of additional chess pieces the movements and capturing moves of each of said eight additional protective pieces on each one of said chessboards and from one of said chessboards to another one of said chessboards are governed by the same rules as govern the movements and capturing moves of a pawn on each one of said chessboards and from one of said chessboards to another one of said chessboards, the movements and capturing moves of a first additional royalty piece and a second additional royalty piece on each one of said chessboards and from one of said chessboards to another one of said chessboards are governed by the same rules as govern the movements and capturing moves of a knight on each one of said chessboards and from one of said chessboards to another one of said chessboards, the movements and capturing moves of a third additional royalty piece and a fourth additional royalty piece on each one of said chessboards and from one of said chessboards to another one of said chessboards are governed by the same rules as govern the movements and capturing moves of a bishop on each one of said chessboards and from one of said chessboards to another one of said chessboards, the movements and capturing moves of a fifth additional royalty piece and a sixth additional royalty piece on each one of said chessboards and from one of said chessboards to another one of said chessboards are governed by the same rules as govern the movements and capturing moves of a rook on each one of said chessboards and from one of said chessboards to another one of said chessboards, the movements and capturing moves of a seventh additional royalty piece on each one of said chessboards and from one of said chessboards to another one of said chessboards are governed by the same rules as govern the movements and capturing moves of a queen on each one of said chessboards and from one of said chessboards to another one of said chessboards, and the movements and capturing moves of an eighth additional royalty piece on each one of said chessboards and from one of said chessboards to another one of said chessboards are governed by the same rules as govern the movements and capturing moves of a king on each one of said chessboards and from one of said chessboards to another one of said chessboards except that said eighth additional royalty piece may not experience castling.

42. The method of claim 41 wherein in each of said supplemental sets of additional chess pieces each of said eight additional protective pieces initially occupies a position corresponding to the initial position of a pawn in a conventional set of standard chess pieces, and each of said eight additional royalty pieces initially occupies a position corresponding to the initial position in a conventional set of standard chess pieces of the one of said eight conventional royalty pieces whose movements and capturing moves on each of said chessboards and from one of said chessboards to another of said chessboards are governed by the same rules.

43. The method of claim 40 wherein in each of said supplemental sets of additional chess pieces said eight additional protective pieces comprise eight additional pawns, and said eight additional royalty pieces comprise a first additional royalty piece, a second additional royalty piece, two additional knights, two additional bishops and two additional rooks.

44. The method of claim 43 wherein in each of said supplemental sets of additional chess pieces each of said eight additional pawns initially occupies a position corresponding to the initial position of a pawn in a conventional set of standard chess pieces, each of said two additional knights initially occupies a position corresponding to the initial position of a knight in a conventional set of standard chess pieces, each of said two additional bishops initially occupies a position corresponding to the initial position of a bishop in a conventional set of standard chess pieces, each of said two additional rooks initially occupies a position corresponding to the initial position of a rook in a conventional set of standard chess pieces, said first additional royalty piece initially occupies a position corresponding to the initial position of a queen in a conventional set of standard chess pieces, and said second additional royalty piece initially occupies a position corresponding to the initial position of a king in a conventional set of standard chess pieces.

45. The method of claims 43 or 44 wherein said rules specify that in each of said supplemental sets of additional chess pieces the movements and capturing moves of said first additional royalty piece on each one of said chessboards and from one of said chessboards to another one of said chessboards are governed by the same rules as govern the movements and capturing moves of a queen on each one of said chessboards and from one of said chessboards to another one of said chessboards, and the movements and capturing moves of said second additional royalty piece on each one of said chessboards and from one of said chessboards to another one of said chessboards are governed by the same rules as govern the movements and capturing moves of a king on each one of said chessboards and from one of said chessboards to another one of said chessboards except that said second additional royalty piece may not experience castling.

46. The method of claim 45 wherein all except the first of said plurality of chessboards are substantially transparent.

47. The method of claim 46 wherein said plurality of chessboards comprises fewer than eight chessboards.

48. The method of claim 47 wherein said plurality of chessboards comprises three chessboards.

49. The method of claim 48 wherein said first of said plurality of chessboards is the lowermost of said plurality of chessboards.

50. The method of claim 49 wherein said visual differentiation means comprises contrasting colorations.

51. The method of claim 50 wherein said contrasting colorations are black and white.

52. A method of enabling the playing of a multi-level chess game, said method comprising the steps of:

(a) providing first, second and third chessboards;

(b) arranging said chessboards in vertical spaced relation to one other;

(c) providing a pair of conventional sets of standard chess pieces, each member of said pair having means for visual differentiation from the other member of said pair, each of said conventional sets of standard chess pieces comprising eight conventional protective pieces and eight conventional royalty pieces, said eight conventional protective pieces comprising eight pawns and said eight conventional royalty pieces comprising two knights, two bishops, two rooks, a queen and a king, said conventional sets of standard chess pieces being initially positioned opposite one another in standard fashion on said first chessboard;

(d) providing a pair of supplemental sets of additional chess pieces, each member of said pair having means for visual differentiation from the other member of said pair, each of said supplemental sets of additional chess pieces consisting of eight additional protective pieces and eight additional royalty pieces, said supplemental sets of additional chess pieces being initially positioned opposite one another in standard fashion on said third chessboard; and (e) providing a set of predetermined rules to govern the movements and capturing moves from one of said chessboards to another one of said chessboards of each chess piece in said conventional sets of standard chess pieces, and to govern the movements and capturing moves on each one of said chessboards and from one of said chessboards to another one of said chessboards of each chess piece in said supplemental sets of additional chess pieces.

53. The method of claim 52 wherein said chessboards are substantially identical.

54. The method of claim 53 wherein said chessboards are oriented in congruent relation to one another.

55. The method of claim 54 wherein said rules specify that in each of said supplemental sets of additional chess pieces the movements and capturing moves of each of said eight additional protective pieces on each one of said chessboards and from one of said chessboards to another one of said chessboards are governed by the same rules as govern the movements and capturing moves of a pawn on each one of said chessboards and from one of said chessboards to another one of said chessboards, the movements and capturing moves of a first additional royalty piece and a second additional royalty piece on each one of said chessboards and from one of said chessboards to another one of said chessboards are governed by the same rules as govern the movements and capturing moves of a knight on each one of said chessboards and from one of said chessboards to another one of said chessboards, the movements and capturing moves of a third additional royalty piece and a fourth additional royalty piece on each one of said chessboards and from one of said chessboards to another one of said chessboards are governed by the same rules as govern the movements and capturing moves of a bishop on each one of said chessboards and from one of said chessboards to another one of said chessboards, the movements and capturing moves of a fifth additional royalty piece and a sixth additional royalty piece on each one of said chessboards and from one of said chessboards to another one of said chessboards are governed by the same rules as govern the movements and capturing moves of a rook on each one of said chessboards and from one of said chessboards to another one of said chessboards, the movements and capturing moves of a seventh additional royalty piece on each one of said chessboards and from one of said chessboards to another one of said chessboards are governed by the same rules as govern the movements and capturing moves of a queen on each one of said chessboards and from one of said chessboards to another one of said chessboards, and the movements and capturing moves of an eighth additional royalty piece on each one of said chessboards and from one of said chessboards to another one of said chessboards are governed by the same rules as govern the movements and capturing moves of a king on each one of said chessboards and from one of said chessboards to another one of said chessboards except that said eighth additional royalty piece may not experience castling.

56. The method of claim 55 wherein in each of said supplemental sets of additional chess pieces each of said eight additional protective pieces initially occupies a position corresponding to the initial position of a pawn in a conventional set of standard chess pieces, and each of said eight additional royalty pieces initially occupies a position corresponding to the initial position in a conventional set of standard chess pieces of the one of said eight conventional royalty pieces whose movements and capturing moves on each of said chessboards and from one of said chessboards to another of said chessboards are governed by the same rules.

57. The method of claim 54 wherein in each of said supplemental sets of additional chess pieces said eight additional protective pieces comprise eight additional pawns, and said eight additional royalty pieces comprise two additional knights, two additional bishops, two additional rooks, an additional royalty piece denominated a prince, and an additional royalty piece denominated a princess.

58. The method of claim 57 wherein in each of said supplemental sets of additional chess pieces each of said eight additional pawns initially occupies a position corresponding to the initial position of a pawn in a conventional set of standard chess pieces, each of said two additional knights initially occupies a position corresponding to the initial position of a knight in a conventional set of standard chess pieces, each of said two additional bishops initially occupies a position corresponding to the initial position of a bishop in a conventional set of standard chess pieces, each of said two additional rooks initially occupies a position corresponding to the initial position of a rook in a conventional set of standard chess pieces, said prince initially occupies a position corresponding to the initial position of a king in a conventional set of standard chess pieces, and said princess initially occupies a position corresponding to the initial position of a queen in a conventional set of standard chess pieces.

59. The method of claims 57 or 58 wherein said rules specify that in each of said supplemental sets of additional chess pieces the movements and capturing moves of said prince on each one of said chessboards and from one of said chessboards to another one of said chessboards are governed by the same rules as govern the movements and capturing moves of a king on each one of said chessboards and from one of said chessboards to another one of said chessboards except that said prince may not experience castling, and the movements and capturing moves of said princess on each one of said chessboards and from one of said chessboards to another one of said chessboards are governed by the same rules as govern the movements and capturing moves of a queen on each one of said chessboards and from one of said chessboards to another one of said chessboards.

60. The method of claim 59 wherein at least two of said chessboards are substantially transparent.

61. The method of claim 60 wherein said first chessboard is the lowermost of said chessboards and said third chessboard is the uppermost of said chessboards.

62. The method of claim 61 wherein said second chessboard and said third chessboard are substantially transparent.

63. The method of claim 62 wherein said visual differentiation means comprises contrasting colorations.

64. The method of claim 63 wherein said contrasting colorations are black and white.

65. A method of enabling the playing of a multi-level chess game on a programmable electronic digital apparatus, said apparatus comprising (a) digital storage means, (b) digital input means and (c) output means comprising a display, said method comprising the step of providing digital programming means for said apparatus, said digital programming means being capable of depicting on said display an odd-numbered plurality of chessboards;

a pair of conventional sets of standard chess pieces, each member of said pair having means for visual differentiation from the other member of said pair, each of said conventional sets of standard chess pieces comprising eight conventional protective pieces and eight conventional royalty pieces, said eight conventional protective pieces comprising eight pawns and said eight conventional royalty pieces comprising two knights, two bishops, two rooks, a queen and a king, said conventional sets of standard chess pieces being initially positioned opposite one another in standard fashion on the first of said plurality of chessboards; and at least one pair of supplemental sets of additional chess pieces, each member of said at least one pair having means for visual differentiation from the other member of said at least one pair, the number of said supplemental sets of additional chess pieces being an even number that is one integer less than the number of said plurality of chessboards, each of said supplemental sets of additional chess pieces consisting of eight additional protective pieces and eight additional royalty pieces, each pair of said at least one pair of supplemental sets of additional chess pieces being initially positioned in standard fashion such that one member of each said pair is positioned opposite the other member of said pair on an odd-numbered one of said chessboards other than the first of said plurality of chessboards;

said digital programming means further being capable of depicting on said display the movements and capturing moves of said chess pieces in response to commands received through said input means and in accordance with a set of predetermined rules stored in said storage means and governing said movements and capturing moves.

66. The method of claim 65 wherein said chessboards are substantially identical.

67. The method of claim 66 wherein said rules specify that in each of said supplemental sets of additional chess pieces the movements and capturing moves of each one of said eight additional protective pieces on each one of said chessboards and from one of said chessboards to another one of said chessboards are governed by the same rules as govern the movements and capturing moves of a pawn on each one of said chessboards and from one of said chessboards to another one of said chessboards, the movements and capturing moves of a first additional royalty piece and a second additional royalty piece on each one of said chessboards and from one of said chessboards to another one of said chessboards are governed by the same rules as govern the movements and capturing moves of a knight on each one of said chessboards and from one of said chessboards to another one of said chessboards, the movements and capturing moves of a third additional royalty piece and a fourth additional royalty piece on each one of said chessboards and from one of said chessboards to another one of said chessboards are governed by the same rules as govern the movements and capturing moves of a bishop on each one of said chessboards and from one of said chessboards to another one of said chessboards, the movements and capturing moves of a fifth additional royalty piece and a sixth additional royalty piece on each one of said chessboards and from one of said chessboards to another one of said chessboards are governed by the same rules as govern the movements and capturing moves of a rook on each one of said chessboards and from one of said chessboards to another one of said chessboards, the movements and capturing moves of a seventh additional royalty piece on each one of said chessboards and from one of said chessboards to another one of said chessboards are governed by the same rules as govern the movements and capturing moves of a queen on each one of said chessboards and from one of said chessboards to another one of said chessboards, and the movements and capturing moves of an eighth additional royalty piece on each one of said chessboards and from one of said chessboards to another one of said chessboards are governed by the same rules as govern the movements and capturing moves of a king on each one of said chessboards and from one of said chessboards to another one of said chessboards except that said eighth additional royalty piece may not experience castling.

68. The method of claim 67 wherein in each of said supplemental sets of additional chess pieces each of said eight additional protective pieces initially occupies a position corresponding to the initial position of a pawn in a conventional set of standard chess pieces, and each of said eight additional royalty pieces initially occupies a position corresponding to the initial position in a conventional set of standard chess pieces of the one of said eight conventional royalty pieces whose movements and capturing moves on each of said chessboards and from one of said chessboards to another of said chessboards are governed by the same rules.

69. The method of claim 66 wherein in each of said supplemental sets of additional chess pieces said eight additional protective pieces comprise eight additional pawns, and said eight additional royalty pieces comprise a first additional royalty piece, a second additional royalty piece, two additional knights, two additional bishops and two additional rooks.

70. The method of claim 69 wherein in each of said supplemental sets of additional chess pieces each of said eight additional pawns initially occupies a position corresponding to the initial position of a pawn in a conventional set of standard chess pieces, each of said two additional knights initially occupies a position corresponding to the initial position of a knight in a conventional set of standard chess pieces, each of said two additional bishops initially occupies a position corresponding to the initial position of a bishop in a conventional set of standard chess pieces, each of said two additional rooks initially occupies a position corresponding to the initial position of a rook in a conventional set of standard chess pieces, said first additional royalty piece initially occupies a position corresponding to the initial position of a queen in a conventional set of standard chess pieces, and said second additional royalty piece initially occupies a position corresponding to the initial position of a king in a conventional set of standard chess pieces.

71. The method of claims 69 or 70 wherein said rules specify that in each of said supplemental sets of additional chess pieces the movements and capturing moves of said first additional royalty piece on each one of said chessboards and from one of said chessboards to another one of said chessboards are governed by the same rules as govern the movements and capturing moves of a queen on each one of said chessboards and from one of said chessboards to another one of said chessboards, and the movements and capturing moves of said second additional royalty piece on each one of said chessboards and from one of said chessboards to another one of said chessboards are governed by the same rules as govern the movements and capturing moves of a king on each one of said chessboards and from one of said chessboards to another one of said chessboards except that said second additional royalty piece may not experience castling.

72. The method of claim 71 wherein said plurality of chessboards comprises fewer than eight chessboards.

73. The method of claim 72 wherein said plurality of chessboards comprises three chessboards.

74. The method of claim 73 wherein said visual differentiation means comprises contrasting colorations.

* * * * *